US010161018B2

(12) United States Patent
Na et al.

(10) Patent No.: US 10,161,018 B2
(45) Date of Patent: Dec. 25, 2018

(54) BULK PLATINUM-PHOSPHORUS GLASSES BEARING NICKEL, PALLADIUM, SILVER, AND GOLD

(71) Applicant: Glassimetal Technology, Inc., Pasadena, CA (US)

(72) Inventors: Jong Hyun Na, Pasadena, CA (US); Kyung-Hee Han, Pasadena, CA (US); Maximilien Launey, Pasadena, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 338 days.

(21) Appl. No.: 15/159,565

(22) Filed: May 19, 2016

(65) Prior Publication Data

US 2016/0340758 A1 Nov. 24, 2016

Related U.S. Application Data

(60) Provisional application No. 62/163,867, filed on May 19, 2015, provisional application No. 62/201,315, filed on Aug. 5, 2015, provisional application No. 62/214,116, filed on Sep. 3, 2015.

(51) Int. Cl.
*C22C 45/00* (2006.01)
*C22C 5/04* (2006.01)

(52) U.S. Cl.
CPC ..... *C22C 5/04* (2013.01); *C22C 45/003* (2013.01)

(58) Field of Classification Search
CPC ..... C22C 45/003; C22C 5/04
See application file for complete search history.

(56) References Cited

U.S. PATENT DOCUMENTS

| | | | |
|---|---|---|---|
| 4,175,950 | A | 11/1979 | Linares et al. |
| 4,696,731 | A | 9/1987 | Tenhover |
| 4,781,803 | A | 11/1988 | Harris et al. |
| 5,350,468 | A | 9/1994 | Masumoto et al. |

(Continued)

FOREIGN PATENT DOCUMENTS

| | | |
|---|---|---|
| CN | 101191184 | 6/2008 |
| JP | 3808354 | 8/2006 |

OTHER PUBLICATIONS

Saotome et al., "Characteristic behavior of Pt-based metallic glass under rapid heating and it application to microforming," Materials Science and Engineering A, 2004, vol. 375-377, pp. 389-393.

(Continued)

*Primary Examiner* — Lois L Zheng
(74) *Attorney, Agent, or Firm* — Polsinelli PC

(57) ABSTRACT

The disclosure provides Pt—P metallic glass-forming alloys and metallic glasses comprising at least two of Ni, Pd, Ag, and Au and optionally Si as well as potentially other elements, where the weight fraction of Pt is between 74 and 91 percent, and where the at least two of Ni, Pd, Ag, and Au contribute to increase the critical rod diameter of the alloy in relation to a Pt—P alloy free of Ni, Pd, Ag, and Au or a Pt—P alloy comprising only one of these elements. In embodiments where the PT850 hallmark is satisfied, alloys according to the disclosure are capable of forming metallic glass rods with diameters in excess of 3 mm, and in some embodiments 30 mm or larger.

20 Claims, 27 Drawing Sheets

(56) References Cited

U.S. PATENT DOCUMENTS

| | | | |
|---|---|---|---|
| 6,695,936 | B2 | 2/2004 | Johnson |
| 6,749,698 | B2 | 6/2004 | Shimizu et al. |
| 7,582,172 | B2 | 9/2009 | Schroers et al. |
| 8,066,827 | B2 | 11/2011 | Demetriou et al. |
| 8,361,250 | B2 | 1/2013 | Demetriou et al. |
| 9,119,447 | B2 | 9/2015 | Demetriou et al. |
| 2006/0157164 | A1 | 7/2006 | Johnson et al. |
| 2009/0236494 | A1 | 9/2009 | Hata et al. |
| 2013/0139931 | A1 | 6/2013 | Demetriou et al. |
| 2013/0306196 | A1 | 11/2013 | Prest et al. |
| 2014/0009872 | A1 | 1/2014 | Prest et al. |
| 2014/0096874 | A1 | 10/2014 | Weber |
| 2015/0267286 | A1 | 9/2015 | Na et al. |

OTHER PUBLICATIONS

Biggs, "The Hardening of Platinum Alloys for Potential Jewelry Application," *Platinum Metals Review*, 2005, vol. 49, No. 1, pp. 2-15.

BULK PLATINUM-PHOSPHORUS GLASSES BEARING NICKEL, PALLADIUM, SILVER, AND GOLD

CROSS-REFERENCE TO RELATED APPLICATIONS

The present application claims the benefit under 35 U.S.C. § 119(e) of U.S. Provisional Patent Application No. 62/163,867, entitled "Bulk Platinum-Phosphorus Glasses Bearing Nickel, Palladium and Gold" filed on May 19, 2015, U.S. Provisional Patent Application No. 62/201,315 entitled "Bulk Platinum-Phosphorus Glasses Bearing Nickel, Palladium, Silver and Gold" filed on Aug. 5, 2015, and U.S. Provisional Patent Application No. 62/214,116 entitled "Bulk Platinum-Phosphorus Glasses Bearing Nickel, Palladium, Silver and Gold" filed on Sep. 3, 2015, which are incorporated herein by reference in their entirety.

FIELD

The disclosure is directed to Pt—P alloys bearing at least two of Ni, Pd, Ag, and Au and optionally Si and are capable of forming metallic glass samples with a critical rod diameter of at least 3 mm.

BACKGROUND

U.S. Pat. No. 6,749,698 entitled "Precious Metal Based Amorphous Alloys," U.S. Pat. No. 7,582,172 entitled "Pt-Based Bulk Solidifying Amorphous Alloys," and U.S. Patent Application No. 62/109,385 entitled "Bulk Platinum-Copper-Phosphorus Glasses Bearing Boron, Silver, and Gold," the disclosures of which are incorporated herein by reference in their entirety, disclose ternary Pt—P alloys bearing Cu along with other elements having Pt weight fractions in the range of 74 to 91 percent that are capable of forming metallic glass samples. The patents make no reference on the possible bulk-glass-forming ability of Pt—P alloys that are free of Cu.

U.S. Pat. No. 8,361,250 entitled "Amorphous Platinum-Rich Alloys," the disclosure of which is incorporated herein by reference in its entirety, discloses that B along with Si in ternary Pt—P alloys with various other elemental additions where the weight fraction of Pt is at least 92.5 percent. The patent does not disclose Pt—P alloys that have lower Pt weight fractions.

Zhang et al. (L. Zhang, S. Pang, C. Ma, T. Zhang, "Formation of Bulk Pt—Pd—Ni—P Glassy Alloys," the disclosure of which is incorporated herein by reference in its entirety) discloses the formation of bulk-glass-forming Pt—P alloys bearing Pd and Ni having a Pt weight fraction of 57 percent capable of forming metallic glass rods with diameters of 3 mm. The article does not present bulk glass formation at higher Pt weight fractions. At higher Pt weight fractions the article presents glasses only in ribbon form that are only 20 micrometers thick.

BRIEF SUMMARY

The disclosure provides Pt—P metallic glass-forming alloys and metallic glasses comprising at least two of Ni, Pd, Ag, and Au and optionally Si as well as potentially other elements, where the weight fraction of Pt is between 74 and 91 percent, and where the at least two of Ni, Pd, Ag, and Au contribute to increase the critical rod diameter of the alloy in relation to a Pt—P alloy free of Ni, Pd, Ag, and Au or a Pt—P alloy comprising only one of these elements.

In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 15 to 30 percent. In some embodiments, the atomic fraction of P is in the range of 18 to 30 percent. The alloy also comprises at least two additional elements selected from the group consisting of Ni, Pd, Ag, and Au, where the atomic fraction of each of the at least two additional elements is in the range of 0.1 to 30 percent. Among other additional elements, the alloy further comprises Cu in an atomic fraction of less than 2 percent and Si in an atomic fraction of up to 15 percent. The critical rod diameter of the alloy is at least 3 mm.

In another embodiment, the alloy optionally comprises Cu in an atomic fraction of less than 1.75 percent.

In another embodiment, the alloy optionally comprises Cu in an atomic fraction of less than 1.5 percent.

In another embodiment, the alloy optionally comprises Cu in an atomic fraction of less than 1.25 percent.

In another embodiment, the alloy optionally comprises Cu in an atomic fraction of less than 1 percent.

In another embodiment, the alloy optionally comprises Cu in an atomic fraction of less than 0.75 percent.

In another embodiment, the alloy optionally comprises Cu in an atomic fraction of less than 0.5 percent.

In another embodiment, the alloy optionally comprises Cu in an atomic fraction of less than 0.25 percent.

In another embodiment, the alloy is free of Cu.

In another embodiment, the atomic fraction of Pt is in the range of 45 to 60 percent, the atomic fraction of P is in the range of 20 to 28, the atomic fraction of each of the at least two additional elements selected from the group consisting of Ni, Pd, Ag, and Au is in the range of 0.1 to 30 percent, and wherein the Pt weight fraction is at least 80.0 percent.

In another embodiment, the weight fraction of Pt is between 79 and 91 percent.

In another embodiment, the atomic fraction of Pt is in the range of 50 to 65 percent, the atomic fraction of P is in the range of 20 to 28 percent, the atomic fraction of each of the at least two additional elements selected from the group consisting of Ni, Pd, Ag, and Au is in the range of 0.1 to 23 percent, and wherein the Pt weight fraction is at least 85.0 percent.

In another embodiment, the atomic fraction of Pt is in the range of 50 to 65 percent, the atomic fraction of P is in the range of 20 to 28 percent, the atomic fraction of each of the at least two additional elements selected from the group consisting of Ni, Pd, Ag, and Au is in the range of 0.1 to 26 percent, and wherein the Pt weight fraction is at least 85.0 percent.

In another embodiment, the weight fraction of Pt is between 84 and 91 percent.

In another embodiment, the atomic fraction of Pt is in the range of 55 to 70 percent, the atomic fraction of P is in the range of 20 to 28 percent, the atomic fraction of each of the at least two additional elements selected from the group consisting of Ni, Pd, Ag, and Au is in the range of 0.1 to 14 percent, and wherein the Pt weight fraction is at least 90.0 percent.

In another embodiment, the alloy comprises Ni and also comprises Cu in an atomic fraction of either less than 2 percent, or less than 10 percent of the Ni atomic fraction, whichever is lower.

In another embodiment, the alloy also comprises at least one of Rh and Ir, each in an atomic fraction of up to 5 percent.

In another embodiment, the alloy also comprises at least one of B, Si, Ge, and Sb, each in an atomic fraction of up to 3 percent.

In another embodiment, the alloy also comprises at least one of Sn, Zn, Fe, Ru, Cr, Mo, and Mn, each in an atomic fraction of up to 3 percent.

In another embodiment, the alloy also comprises at least one of Cu, Rh, Ir, B, Si, Ge, Sb, Sn, Zn, Fe, Ru, Cr, Mo, and Mn, each in an atomic fraction of less than 2 percent.

In another embodiment, the alloy comprises Ni and also comprises at least one of Cu, Rh, Ir, B, Si, Ge, Sb, Sn, Zn, Fe, Ru, Cr, Mo, and Mn, each in an atomic fraction of less than 2 percent, or less than 10 percent of the Ni atomic fraction, whichever is lower.

In another embodiment, the disclosure is directed to an alloy capable of forming a metallic glass having a composition represented by the following formula (subscripts denote atomic percentages):

$$Pt_{(100-a-b-c-d-e)}Ni_aPd_bAg_cAu_dP_e$$

where:

a is up to 30;

b is up to 30;

c is up to 30;

d is up to 30;

e ranges from 15 to 30;

wherein at least two of a, b, c, and d are at least 0.1;

wherein the Pt weight fraction is between 74 and 91 percent; and wherein the critical rod diameter of the alloy is at least 3 mm.

In another embodiment, a and b are at least 0.1.

In another embodiment, a and c are at least 0.1.

In another embodiment, a and d are at least 0.1.

In another embodiment, b and c are at least 0.1.

In another embodiment, b and d are at least 0.1.

In another embodiment, c and d are at least 0.1.

In another embodiment, a, b, and c are at least 0.1.

In another embodiment, a, b, and d are at least 0.1.

In another embodiment, a, c, and d are at least 0.1.

In another embodiment, b, c, and d are at least 0.1.

In another embodiment, a, b, c, and d are at least 0.1.

In another embodiment, at least two of a, b, c, and d are at least 0.2.

In another embodiment, at least two of a, b, c, and d are at least 0.25.

In another embodiment, e ranges from 18 to 30.

In another embodiment, the Pt weight fraction is at least 80.0 percent.

In another embodiment, the Pt weight fraction is between 79 and 91 percent.

In another embodiment, a, b, c, and d are up to 23, and wherein the Pt weight fraction is at least 85.0 percent.

In another embodiment, a, b, c, and d are up to 26, and wherein the Pt weight fraction is at least 85.0 percent.

In another embodiment, a, b, c, and d are up to 23, and wherein the Pt weight fraction is between 84 and 91 percent.

In another embodiment, a, b, c, and d are up to 26, and wherein the Pt weight fraction is between 84 and 91 percent.

In another embodiment, a, b, c, and d are up to 14, and wherein the Pt weight fraction is at least 90.0 percent.

In another embodiment, e ranges from 20 to 28, and wherein the critical rod diameter of the alloy is at least 5 mm.

In another embodiment, a ranges from 8 to 24, b ranges from 0.1 to 10, c and d are 0, and e ranges from 20 to 29.

In another embodiment, a ranges from 12 to 20, b ranges from 0.1 to 6, c and d are 0, e ranges from 22 to 27, and wherein the critical rod diameter of the alloy is at least 5 mm.

In another embodiment, a ranges from 14 to 18, b ranges from 0.5 to 4, c and d are 0, e ranges from 23 to 26, and wherein the critical rod diameter of the alloy is at least 12 mm.

In another embodiment, a ranges from 4 to 20, c ranges from 0.1 to 10, b and d are 0, and e ranges from 20 to 28.

In another embodiment, a ranges from 7 to 19, c ranges from 0.2 to 8, b and d are 0, e ranges from 23 to 27, and wherein the critical rod diameter of the alloy is at least 5 mm.

In another embodiment, a ranges from 13 to 19, c ranges from 0.5 to 4, b and d are 0, e ranges from 24 to 26, and wherein the critical rod diameter of the alloy is at least 15 mm.

In another embodiment, a ranges from 6 to 26, d ranges from 0.1 to 8, b and c are 0, and e ranges from 20 to 28.

In another embodiment, a ranges from 10 to 22, d ranges from 0.1 to 6, b and c are 0, e ranges from 23 to 27, and wherein the critical rod diameter of the alloy is at least 5 mm.

In another embodiment, a ranges from 12 to 20, d ranges from 0.1 to 2.5, b and c are 0, e ranges from 24 to 26, and wherein the critical rod diameter of the alloy is at least 10 mm.

In another embodiment, b ranges from 2 to 12, c ranges from 0.1 to 10, a and d are 0, and e ranges from 18 to 25.

In another embodiment, b ranges from 3 to 11, c ranges from 3 to 9, a and d are 0, e ranges from 20 to 24, and wherein the critical rod diameter of the alloy is at least 4 mm.

In another embodiment, b ranges from 7 to 10, c ranges from 4 to 5, a and d are 0, e ranges from 21.5 to 23, and wherein the critical rod diameter of the alloy is at least 6 mm.

In another embodiment, the disclosure is directed to an alloy capable of forming a metallic glass having a composition represented by the following formula (subscripts denote atomic percentages):

$$Pt_{(100-a-b-c)}Ni_aPd_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In other embodiments, the critical rod diameter of the alloy is at least 5 mm.

In other embodiments, the critical rod diameter of the alloy is at least 10 mm.

In other embodiments, the critical rod diameter of the alloy is at least 15 mm.

In other embodiments, the critical rod diameter of the alloy is at least 20 mm.

In other embodiments, the critical rod diameter of the alloy is at least 25 mm.

In another embodiment, a ranges from 8 to 24, b ranges from 0.1 to 10, c ranges from 20 to 29, and the Pt weight fraction is at least 85.0 percent.

In another embodiment, a ranges from 10 to 22, b ranges from 0.1 to 8, c ranges from 21 to 28, and the Pt weight fraction is at least 85.0 percent.

In another embodiment, a ranges from 12 to 20, b ranges from 0.1 to 6, c ranges from 22 to 27, and the Pt weight fraction is at least 85.0 percent.

In another embodiment, a ranges from 12 to 20, b ranges from 0.1 to 6, c ranges from 22 to 27, and the Pt weight fraction is at least 85.0 percent, wherein the critical rod diameter of the alloy is at least 5 mm.

In another embodiment, a ranges from 13 to 19, b ranges from 0.25 to 5, c ranges from 23 to 26, and the Pt weight fraction is at least 85.0 percent.

In another embodiment, a ranges from 13 to 19, b ranges from 0.25 to 5, c ranges from 23 to 26, and the Pt weight fraction is at least 85.0 percent, wherein the critical rod diameter of the alloy is at least 8 mm.

In another embodiment, a ranges from 14 to 18, b ranges from 0.5 to 4, c ranges from 23 to 26, and the Pt weight fraction is at least 85.0 percent.

In another embodiment, a ranges from 14 to 18, b ranges from 0.5 to 4, c ranges from 23 to 26, and the Pt weight fraction is at least 85.0 percent, wherein the critical rod diameter of the alloy is at least 12 mm.

In another embodiment, a ranges from 14.5 to 17, b ranges from 1 to 3.5, c ranges from 23 to 26, and the Pt weight fraction is at least 85.0 percent.

In another embodiment, a ranges from 14.5 to 17, b ranges from 1 to 3.5, c ranges from 23 to 26, and the Pt weight fraction is at least 85.0 percent, wherein the critical rod diameter of the alloy is at least 15 mm.

In another embodiment, a ranges from 15 to 16.5, b ranges from 1.5 to 3, c ranges from 23.5 to 25.5 and the Pt weight fraction is at least 85.0 percent.

In another embodiment, a ranges from 15 to 16.5, b ranges from 1.5 to 3, c ranges from 23.5 to 25.5 and the Pt weight fraction is at least 85.0 percent, wherein the critical rod diameter of the alloy is at least 20 mm.

In another embodiment, a ranges from 15.25 to 16.25, b ranges from 2 to 2.75, c ranges from 24 to 25 and the Pt weight fraction is at least 85.0 percent.

In another embodiment, a ranges from 15.25 to 16.25, b ranges from 2 to 2.75, c ranges from 24 to 25 and the Pt weight fraction is at least 85.0 percent, wherein the critical rod diameter of the alloy is at least 22 mm.

In another embodiment, the disclosure is directed to an alloy capable of forming a metallic glass having a composition represented by the following formula (subscripts denote atomic percentages):

$$Pt_{(100-a-b-c)}Ni_aAg_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In other embodiments, the critical rod diameter is at least 5 mm.

In other embodiments, the critical rod diameter is at least 10 mm.

In other embodiments, the critical rod diameter is at least 15 mm.

In other embodiments, the critical rod diameter is at least 15 mm.

In other embodiments, the critical rod diameter is at least 20 mm.

In other embodiments, the critical rod diameter is at least 25 mm.

In another embodiment, a ranges from 4 to 20, b ranges from 0.1 to 10, c ranges from 20 to 28, and the Pt weight fraction is at least 85.0 percent.

In another embodiment, a ranges from 7 to 19, b ranges from 0.2 to 8, c ranges from 23 to 27, and the Pt weight fraction is at least 85.0 percent.

In another embodiment, a ranges from 7 to 19, b ranges from 0.2 to 8, c ranges from 23 to 27, and the Pt weight fraction is at least 85.0 percent, wherein the critical rod diameter of the alloy is at least 5 mm.

In another embodiment, a ranges from 9 to 19, b ranges from 0.25 to 7, c ranges from 24 to 26, and the Pt weight fraction is at least 85.0 percent.

In another embodiment, a ranges from 9 to 19, b ranges from 0.25 to 7, c ranges from 24 to 26, and the Pt weight fraction is at least 85.0 percent, wherein the critical rod diameter of the alloy is at least 10 mm.

In another embodiment, a ranges from 13 to 19, b ranges from 0.5 to 4, c ranges from 24 to 26, and the Pt weight fraction is at least 85.0 percent.

In another embodiment, a ranges from 13 to 19, b ranges from 0.5 to 4, c ranges from 24 to 26, and the Pt weight fraction is at least 85.0 percent, wherein the critical rod diameter of the alloy is at least 15 mm.

In another embodiment, a ranges from 14 to 18.5, b ranges from 1 to 3.5, c ranges from 24.5 to 25.5 and the Pt weight fraction is at least 85.0 percent.

In another embodiment, a ranges from 14 to 18.5, b ranges from 1 to 3.5, c ranges from 24.5 to 25.5 and the Pt weight fraction is at least 85.0 percent, wherein the critical rod diameter of the alloy is at least 20 mm.

In another embodiment, a ranges from 15 to 18, b ranges from 1.5 to 2.5, c ranges from 24 to 25 and the Pt weight fraction is at least 85.0 percent.

In another embodiment, a ranges from 15 to 18, b ranges from 1.5 to 2.5, c ranges from 24 to 25 and the Pt weight fraction is at least 85.0 percent, wherein the critical rod diameter of the alloy is at least 25 mm.

In another embodiment, the disclosure is directed to an alloy capable of forming a metallic glass having a composition represented by the following formula (subscripts denote atomic percentages):

$$Pt_{(100-a-b-c)}Ni_aAu_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In other embodiments, the critical rod diameter of the alloy is at least 5 mm.

In other embodiments, the critical rod diameter of the alloy is at least 10 mm.

In other embodiments, the critical rod diameter of the alloy is at least 15 mm.

In other embodiments, the critical rod diameter of the alloy is at least 20 mm.

In other embodiments, the critical rod diameter of the alloy is at least 25 mm.

In another embodiment, a ranges from 6 to 26, b ranges from 0.1 to 8, c ranges from 20 to 28, and the Pt weight fraction is at least 85.0 percent.

In another embodiment, a ranges from 10 to 22, b ranges from 0.1 to 6, c ranges from 23 to 27, and the Pt weight fraction is at least 85.0 percent.

In another embodiment, a ranges from 10 to 22, b ranges from 0.1 to 6, c ranges from 23 to 27, and the Pt weight fraction is at least 85.0 percent, wherein the critical rod diameter of the alloy is at least 5 mm.

In another embodiment, a ranges from 12 to 20, b ranges from 0.1 to 2.5, c ranges from 24 to 26, and the Pt weight fraction is at least 85.0 percent.

In another embodiment, a ranges from 12 to 20, b ranges from 0.1 to 2.5, c ranges from 24 to 26, and the Pt weight fraction is at least 85.0 percent, wherein the critical rod diameter of the alloy is at least 10 mm.

In another embodiment, a ranges from 14 to 19, b ranges from 0.25 to 2, c ranges from 24 to 26, and the Pt weight fraction is at least 85.0 percent.

In another embodiment, a ranges from 14 to 19, b ranges from 0.25 to 2, c ranges from 24 to 26, and the Pt weight fraction is at least 85.0 percent, wherein the critical rod diameter of the alloy is at least 15 mm.

In another embodiment, a ranges from 15 to 18.5, b ranges from 0.5 to 1.5, c ranges from 24.5 to 25.5 and the Pt weight fraction is at least 85.0 percent.

In another embodiment, a ranges from 15 to 18.5, b ranges from 0.5 to 1.5, c ranges from 24.5 to 25.5 and the Pt weight fraction is at least 85.0 percent, wherein the critical rod diameter of the alloy is at least 20 mm.

In another embodiment, a ranges from 16.5 to 17.5, b ranges from 0.75 to 1.25, c ranges from 24 to 25 and the Pt weight fraction is at least 85.0 percent.

In another embodiment, a ranges from 16.5 to 17.5, b ranges from 0.75 to 1.25, c ranges from 24 to 25 and the Pt weight fraction is at least 85.0 percent, wherein the critical rod diameter of the alloy is at least 25 mm.

In another embodiment, the disclosure is directed to an alloy capable of forming a metallic glass having a composition represented by the following formula (subscripts denote atomic percentages):

$$Pt_{(100-a-b-c)}Pd_aAg_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In other embodiments, the critical rod diameter is at least 4 mm.

In other embodiments, the critical rod diameter is at least 5 mm.

In other embodiments, the critical rod diameter is at least 6 mm.

In other embodiments, the critical rod diameter is at least 7 mm.

In other embodiments, the critical rod diameter is at least 8 mm.

In another embodiment, a ranges from 2 to 12, b ranges from 0.1 to 10, c ranges from 18 to 25, and the Pt weight fraction is at least 85.0 percent.

In another embodiment, a ranges from 3 to 11, b ranges from 3 to 9, c ranges from 20 to 24, and the Pt weight fraction is at least 85.0 percent.

In another embodiment, a ranges from 3 to 11, b ranges from 3 to 9, c ranges from 20 to 24, and the Pt weight fraction is at least 85.0 percent, wherein the critical rod diameter of the alloy is at least 4 mm.

In another embodiment, a ranges from 6 to 11, b ranges from 3.5 to 6, c ranges from 21 to 23.5, and the Pt weight fraction is at least 85.0 percent.

In another embodiment, a ranges from 6 to 11, b ranges from 3.5 to 6, c ranges from 21 to 23.5, and the Pt weight fraction is at least 85.0 percent, wherein the critical rod diameter of the alloy is at least 5 mm.

In another embodiment, a ranges from 7 to 10, b ranges from 4 to 5, c ranges from 21.5 to 23, and the Pt weight fraction is at least 85.0 percent.

In another embodiment, a ranges from 7 to 10, b ranges from 4 to 5, c ranges from 21.5 to 23, and the Pt weight fraction is at least 85.0 percent, wherein the critical rod diameter of the alloy is at least 6 mm.

In another embodiment, a ranges from 7.5 to 9, b ranges from 4 to 5, c ranges from 21.5 to 22.5, and the Pt weight fraction is at least 85.0 percent.

In another embodiment, a ranges from 7.5 to 9, b ranges from 4 to 5, c ranges from 21.5 to 22.5, and the Pt weight fraction is at least 85.0 percent, wherein the critical rod diameter of the alloy is at least 7 mm.

In another embodiment, the disclosure is directed to an alloy capable of forming a metallic glass having a composition represented by the following formula (subscripts denote atomic percentages):

$$Pt_{(100-a-b-c)}Pd_aAu_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c)}Ag_aAu_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d)}Ni_aPd_bAg_cP_d$$

where:

a ranges from 0.1 to 30;

b ranges from 0.1 to 30;

c ranges from 0.1 to 30;

d ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d)}Ni_aAg_bAu_cP_d$$

where:

a ranges from 0.1 to 30;

b ranges from 0.1 to 30;

c ranges from 0.1 to 30;

d ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d)}Pd_aAg_bAu_cP_d$$

where:

a ranges from 0.1 to 30;

b ranges from 0.1 to 30;

c ranges from 0.1 to 30;

d ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d)}Ni_aPd_bAu_cP_d$$

where:

a ranges from 0.1 to 30;

b ranges from 0.1 to 30;

c ranges from 0.1 to 30;

d ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d)}Ni_aPd_bAg_cP_d$$

where:

a ranges from 0.1 to 30;

b ranges from 0.1 to 30;

c ranges from 0.1 to 30;

d ranges from 15 to 30;

wherein the Pt weight fraction is between 74 and 91 percent; and wherein the critical rod diameter of the alloy is at least 3 mm.

In another embodiment, the disclosure is directed to an alloy capable of forming a metallic glass having a composition represented by the following formula (subscripts denote atomic percentages):

$$Pt_{(100-a-b-c-d-e)}Ni_aPd_bAg_cAu_dP_e$$

where:

a ranges from 0.1 to 30;

b ranges from 0.1 to 30;

c ranges from 0.1 to 30;

d ranges from 0.1 to 30;

e ranges from 15 to 30;

wherein the Pt weight fraction is between 74 and 91 percent; and wherein the critical rod diameter of the alloy is at least 3 mm.

In another embodiment, c ranges from 18 to 30.

In another embodiment, the disclosure is directed to an alloy capable of forming a metallic glass that also comprises Si having a composition represented by the following formula (subscripts denote atomic percentages):

$$Pt_{(100-a-b-c-d-e)}Ni_aPd_bAg_cAu_dP_eSi_f$$

where:

a is up to 30;

b is up to 30;

c is up to 30;

d is up to 30;

e ranges from 5 to 30;

f is up to 20;

wherein at least two of a, b, c, and d are at least 0.1;

wherein the Pt weight fraction is between 74 and 91 percent; and wherein the critical rod diameter of the alloy is at least 3 mm.

In another embodiment, f is at least 0.1.

In another embodiment, f is at least 0.25.

In another embodiment, f is at least 0.5.

In another embodiment, f is between 0.1 and 15.

In another embodiment, f is between 0.25 and 12.

In another embodiment, f is between 0.5 and 10.

In another embodiment, f is between 1 and 8.

In another embodiment, f is between 2 and 7.

In another embodiment, f is between 3 and 6.

In another embodiment, the sum e+f is between 15 and 30.

In another embodiment, the sum e+f is between 20 and 26.

In another embodiment, the sum e+f is between 21 and 25.

In another embodiment, the sum e+f is between 22 and 24.

In another embodiment, a, b, c, and d are up to 26, and wherein the Pt weight fraction is at least 85.0 percent.

In another embodiment, a, b, c, and d are up to 23, and wherein the Pt weight fraction is between 84 and 91 percent.

In another embodiment, b ranges from 2 to 18, c ranges from 0.1 to 10, a and d are 0, e ranges from 10 to 28, and f ranges from 0.1 to 15.

In another embodiment, b ranges from 6 to 13, c ranges from 2 to 7, a and d are 0, e ranges from 12 to 25, f ranges from 0.5 to 10, and wherein the critical rod diameter of the alloy is at least 4 mm.

In another embodiment, b ranges from 8 to 11, c ranges from 3.25 to 4.75, a and d are 0, e ranges from 15 to 23, f ranges from 2 to 7, and wherein the critical rod diameter of the alloy is at least 6 mm.

In another embodiment, the disclosure is directed to an alloy capable of forming a metallic glass that also comprises Si having a composition represented by the following formula (subscripts denote atomic percentages):

$$Pt_{(100-a-b-c)}Pd_aAg_bP_cSi_d$$

where:

a ranges from 0.1 to 30;

b ranges from 0.1 to 30;

c ranges from 5 to 30;

d is up to 20;

wherein the Pt weight fraction is between 74 and 91 percent; and wherein the critical rod diameter of the alloy is at least 3 mm.

In other embodiments, the critical rod diameter is at least 4 mm.

In other embodiments, the critical rod diameter is at least 5 mm.

In other embodiments, the critical rod diameter is at least 6 mm.

In other embodiments, the critical rod diameter is at least 7 mm.

In other embodiments, the critical rod diameter is at least 8 mm.

In other embodiments, the critical rod diameter is at least 9 mm.

In other embodiments, the critical rod diameter is at least 10 mm.

In another embodiment, a ranges from 2 to 18, b ranges from 0.1 to 10, c ranges from 10 to 28, d ranges from 0.1 to 15, and the Pt weight fraction is at least 85.0 percent.

In another embodiment, a ranges from 6 to 13, b ranges from 2 to 7, c ranges from 12 to 25, d ranges from 0.5 to 10, and the Pt weight fraction is at least 85.0 percent.

In another embodiment, a ranges from 6 to 13, b ranges from 2 to 7, c ranges from 12 to 25, d ranges from 0.5 to 10, and the Pt weight fraction is at least 85.0 percent, wherein the critical rod diameter of the alloy is at least 4 mm.

In another embodiment, a ranges from 7 to 12, b ranges from 3 to 5, c ranges from 14 to 24, d ranges from 1 to 8, and the Pt weight fraction is at least 85.0 percent.

In another embodiment, a ranges from 7 to 12, b ranges from 3 to 5, c ranges from 14 to 24, d ranges from 1 to 8, and the Pt weight fraction is at least 85.0 percent, wherein the critical rod diameter of the alloy is at least 5 mm.

In another embodiment, a ranges from 8 to 11, b ranges from 3.25 to 4.75, c ranges from 15 to 23, d ranges from 2 to 7, and the Pt weight fraction is at least 85.0 percent.

In another embodiment, a ranges from 8 to 11, b ranges from 3.25 to 4.75, c ranges from 15 to 23, d ranges from 2 to 7, and the Pt weight fraction is at least 85.0 percent, wherein the critical rod diameter of the alloy is at least 6 mm.

In another embodiment, a ranges from 8.5 to 10.5, b ranges from 3.5 to 4.5, c ranges from 16 to 22, d ranges from 3 to 6, and the Pt weight fraction is at least 85.0 percent.

In another embodiment, a ranges from 8.5 to 10.5, b ranges from 3.5 to 4.5, c ranges from 16 to 22, d ranges from 3 to 6, and the Pt weight fraction is at least 85.0 percent, wherein the critical rod diameter of the alloy is at least 7 mm.

In another embodiment, a ranges from 9 to 10, b ranges from 3.5 to 4.5, c ranges from 16.5 to 21.5, d ranges from 3.5 to 5.5, and the Pt weight fraction is at least 85.0 percent.

In another embodiment, a ranges from 9 to 10, b ranges from 3.5 to 4.5, c ranges from 16.5 to 21.5, d ranges from 3.5 to 5.5, and the Pt weight fraction is at least 85.0 percent, wherein the critical rod diameter of the alloy is at least 8 mm.

In another embodiment, the critical rod diameter of the alloy is at least 4 mm.

In another embodiment, the critical rod diameter of the alloy is at least 5 mm.

In another embodiment, the critical rod diameter of the alloy is at least 6 mm.

In another embodiment, the critical rod diameter of the alloy is at least 7 mm.

In another embodiment, the critical rod diameter of the alloy is at least 8 mm.

In another embodiment, the critical rod diameter of the alloy is at least 7 mm.

In another embodiment, the critical rod diameter of the alloy is at least 10 mm.

In another embodiment, the critical rod diameter of the alloy is at least 7 mm.

In another embodiment, the critical rod diameter of the alloy is at least 7 mm.

In another embodiment, the critical rod diameter of the alloy is at least 13 mm.

In another embodiment, the critical rod diameter of the alloy is at least 7 mm.

In another embodiment, the critical rod diameter of the alloy is at least 17 mm.

In another embodiment, the critical rod diameter of the alloy is at least 7 mm.

In another embodiment, the critical rod diameter of the alloy is at least 25 mm.

In yet another embodiment, the melt of the alloy is fluxed with a reducing agent prior to forming a metallic glass.

In yet another embodiment, the reducing agent is boron oxide.

In yet another embodiment, the temperature of the melt prior to quenching to form a metallic glass is at least 100° C. above the liquidus temperature of the alloy.

In yet another embodiment, the temperature of the melt prior to quenching to form a metallic glass is at least at the liquidus temperature of the alloy.

The disclosure is further directed to a metallic glass according to any of the above formulas and/or formed of any of the foregoing alloys.

The disclosure is also directed to an alloy or a metallic glass having compositions selected from a group consisting of: $Pt_{56.3}Ni_{18.2}Ag_1P_{24.5}$, $Pt_{56.6}Ni_{17.4}Ag_{1.5}P_{24.5}$, $Pt_{56.9}Ni_{16.6}Ag_2P_{24.5}$, $Pt_{57.2}Ni_{15.8}Ag_{2.5}P_{24.5}$, $Pt_{57.4}Ni_{15.1}Ag_3P_{24.5}$, $Pt_{57.7}Ni_{14.3}Ag_{3.5}P_{24.5}$, $Pt_{65}Pd_{8.5}Ag_{4.5}P_{22}$, $Pt_{65.25}Pd_{8.25}Ag_{4.5}P_{22}$, $Pt_{65.5}Pd_8Ag_{4.5}P_{22}$, $Pt_{56.5}Ni_{18.5}Au_{0.5}P_{24.5}$, $Pt_{57.3}Ni_{17.2}Au_1P_{24.5}$, $Pt_{58}Ni_{16}Au_{1.5}P_{24.5}$, $Pt_{56.6}Ni_{17.4}Pd_{1.5}P_{24.5}$, $Pt_{56.9}Ni_{16.6}Pd_2P_{24.5}$, $Pt_{57.2}Ni_{15.8}Pd_{2.5}P_{24.5}$, $Pt_{57.5}Ni_{15}Pd_3P_{24.5}$, $Pt_{63.5}Pd_{9.5}Ag_4P_{20}Si_3$, $Pt_{63.5}Pd_{9.5}Ag_4P_{18.5}Si_{4.5}$, and $Pt_{63.5}Pd_{9.5}Ag_4P_{18}Si_5$, and $Pt_{63.5}Pd_{9.5}Ag_4P_{16}Si_7$.

BRIEF DESCRIPTION OF THE DRAWINGS

The description will be more fully understood with reference to the following figures and data graphs, which are presented as various embodiments of the disclosure and should not be construed as a complete recitation of the scope of the disclosure, wherein.

DETAILED DESCRIPTION

Figure 1:
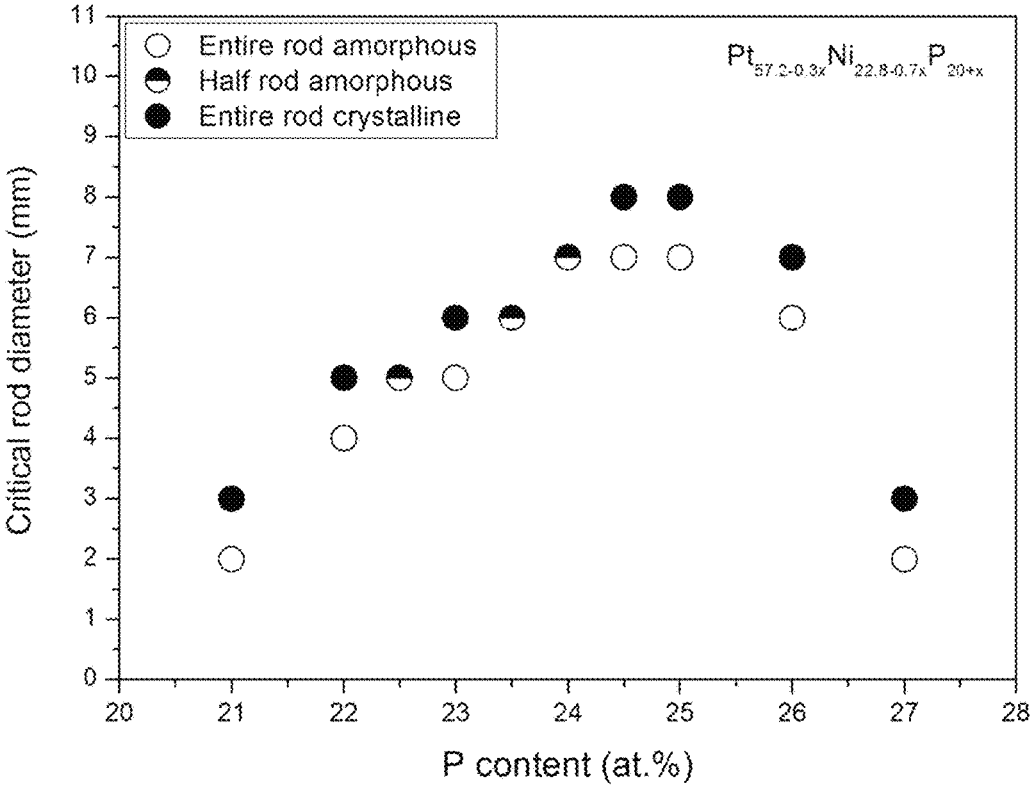
FIG. 1 provides a data plot showing the effect of varying the atomic fraction of P on the glass-forming ability of alloys satisfying the PT850 hallmark according to composition formula $Pt_{57.2-0.3x}Ni_{22.8-0.7x}P_{20+x}$.

The disclosure may be understood by reference to the following detailed description, taken in conjunction with the drawings as described below. It is noted that, for purposes of illustrative clarity, certain elements in various drawings may not be drawn to scale.

Pt-based jewelry alloys typically contain Pt at weight fractions of less than 100%. Hallmarks are used by the jewelry industry to indicate the Pt metal content, or fineness, of a jewelry article by way of a mark, or marks, stamped, impressed, or struck on the metal. These marks may also be referred to as quality or purity marks. Although the Pt content associated with a hallmark varies from country to country, Pt weight fractions of about 75.0% (PT750), 80.0% (PT800), 85.0% (PT850), 90.0% (PT900), and 95.0% (PT950) are commonly used hallmarks in platinum jewelry. In certain embodiments, this disclosure is directed to glass-forming Pt-based alloys or metallic glasses that satisfy the PT750, PT800, PT850, and PT900 hallmarks. Hence, in such embodiments the Pt weight fraction does not exceed 91 percent, or alternatively it ranges from 74 to 91 percent. In other embodiments, this disclosure is directed to glass-forming Pt-based alloys and metallic glasses that satisfy the PT850 and PT900 hallmarks. Hence, in such embodiments the Pt weight fraction ranges from 84 to 91 percent. In yet other embodiments, this disclosure is directed to glass-forming Pt-based alloys or metallic glasses that satisfy the PT850 hallmark. Hence, in such embodiments the Pt weight fraction ranges from 84 to 87 percent. In yet other embodiments, this disclosure is directed to glass-forming Pt-based alloys or metallic glasses that satisfy the PT900 hallmark. Hence, in such embodiments the Pt weight fraction ranges from 89 to 91 percent. In yet other embodiments, this disclosure is directed to glass-forming Pt-based alloys and metallic glasses that satisfy the PT800 and PT850 hallmarks. Hence, in such embodiments the Pt weight fraction ranges from 79 to 86 percent.

In accordance with the provided disclosure and drawings, Pt—P glass-forming alloys and metallic glasses bearing at least two of Ni, Pd, Ag, and Au are provided, where the at least two of Ni, Pd, Ag, and Au contribute to improve the glass-forming ability of the alloy in relation to a Pt—P alloy free of Ni, Pd, Ag, and Au or a Pt—P alloy comprising only one of these elements.

In one embodiment of the disclosure, the glass-forming ability of each alloy is/can be quantified by the "critical rod diameter," defined as the largest rod diameter in which the amorphous phase can be formed when processed by a method of water quenching a quartz tube having 0.5 mm thick walls containing a molten alloy.

In the context of this disclosure, an alloy being free of a certain element means that the concentration of that element in the alloy is consistent with the concentration of an incidental impurity. In the context of this disclosure, the concentration of a certain element in an alloy being 0 means that the concentration of that element is consistent with the concentration of an incidental impurity. In various embodiments, the concentration of an incidental impurity is less than 2 atomic percent. In some embodiments, the concentration of an incidental impurity is less than 1 atomic percent, in other embodiments is less than 0.5 atomic percent, while in yet other embodiments is less than 0.1 atomic percent.

Description of Ni- and Ag-Bearing Pt—P Alloys and Metallic Glass Compositions

In some embodiments, the disclosure is directed to Pt—P alloys and metallic glasses that also bear Ni and Ag. In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 15 to 30 percent. The alloy also comprises Ni and Ag, where the atomic fraction of Ni and Ag is each in the range of 0.1 to 30 percent. Among other additional elements, the alloy may additionally comprise Cu in an atomic fraction of less than 2 percent. The critical rod diameter of the alloy is at least 3 mm.

In another embodiment, the atomic fraction of Pt is in the range of 50 to 65 percent, the atomic fraction of P is in the range of 20 to 28 percent, the atomic fraction of Ni and Ag is each in the range of 0.1 to 23 percent, and wherein the Pt weight fraction is at least 85.0 percent.

In another embodiment, the disclosure is directed to an alloy capable of forming a metallic glass having a composition represented by the following formula (subscripts denote atomic percentages):

$$Pt_{(100-a-b-c)}Ni_aAg_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In another embodiment, a ranges from 4 to 20, b ranges from 0.1 to 10, c ranges from 20 to 28, and the Pt weight fraction is at least 85.0 percent.

To illustrate the effects of including both Ni and Ag in Pt—P alloys in terms of enhancing glass-forming ability, glass-forming ability data for Pt—P alloys that include both Ni and Ag are compared against Pt—P alloys that include only one of Ni and Ag. It is demonstrated that by adding Ag in Pt—Ni—P alloys, or by adding Ni in Pt—Ag—P alloys, the glass-forming ability of the quaternary alloys improve over the ternary alloys. It is also demonstrated that a certain Ni/Ag combination exists where a peak in glass-forming ability is reached in Pt—Ni—Ag—P alloys. At this peak, the critical rod diameter is many times larger than the critical rod diameter of the two ternary alloys Pt—Ni—P and Pt—Ag—P.

Specific embodiments of metallic glasses formed of Pt—P alloys comprising Ni with compositions according to the formula $Pt_{57.2-0.3x}Ni_{22.8-0.7x}P_{20+x}$ with a Pt weight fraction of at least 85.0 percent satisfying the PT850 hallmark are presented in Table 1. In these alloys, the atomic fraction of P varies from 21 to 27 percent, the atomic fraction of Ni varies from about 17 to about 23 percent, and the atomic fraction of Pt varies from about 55 to about 57 percent, while all alloys have weight fractions of Pt of at least 85.0 percent. The critical rod diameters of the example alloys along with the Pt weight percentage are also listed in Table 1. FIG. 1 provides a data plot showing the effect of varying the atomic fraction of P according to the composition formula $Pt_{57.2-0.3x}Ni_{22.8-0.7x}P_{20+x}$ on the glass-forming ability of the alloys.

TABLE 1

Sample metallic glasses demonstrating the effect of increasing the P atomic concentration according to the formula $Pt_{57.2-0.3x}Ni_{22.8-0.7x}P_{20+x}$ on the glass-forming ability of the alloys

| Example | Composition | Pt wt. % | Critical Rod Diameter [mm] |
|---|---|---|---|
| 1 | $Pt_{56.9}Ni_{22.1}P_{21}$ | 85.1 | 2 |
| 2 | $Pt_{56.6}Ni_{21.4}P_{22}$ | 85.1 | 4 |
| 3 | $Pt_{56.4}Ni_{21.1}P_{22.5}$ | 85.0 | 5 |
| 4 | $Pt_{56.3}Ni_{20.7}P_{23}$ | 85.1 | 5 |
| 5 | $Pt_{56.1}Ni_{20.4}P_{23.5}$ | 85.0 | 6 |
| 6 | $Pt_{56}Ni_{20}P_{24}$ | 85.0 | 7 |
| 7 | $Pt_{55.8}Ni_{19.7}P_{24.5}$ | 85.0 | 7 |
| 8 | $Pt_{55.7}Ni_{19.3}P_{25}$ | 85.1 | 7 |
| 9 | $Pt_{55.4}Ni_{18.6}P_{26}$ | 85.1 | 6 |
| 10 | $Pt_{55.1}Ni_{17.9}P_{27}$ | 85.1 | 2 |

As shown in Table 1 and FIG. 1, substituting Pt and Ni by P according to $Pt_{57.2-0.3x}Ni_{22.8-0.7x}P_{20+x}$ results in varying glass-forming ability. Specifically, the critical rod diameter increases from 2 mm for the alloy containing 21 atomic percent P (Example 1), reaches a peak of 7 mm for the alloys containing 24-25 atomic percent P (Examples 6-8), and decreases back to 2 mm for the alloy containing 27 atomic percent P (Example 10).

Figure 2:
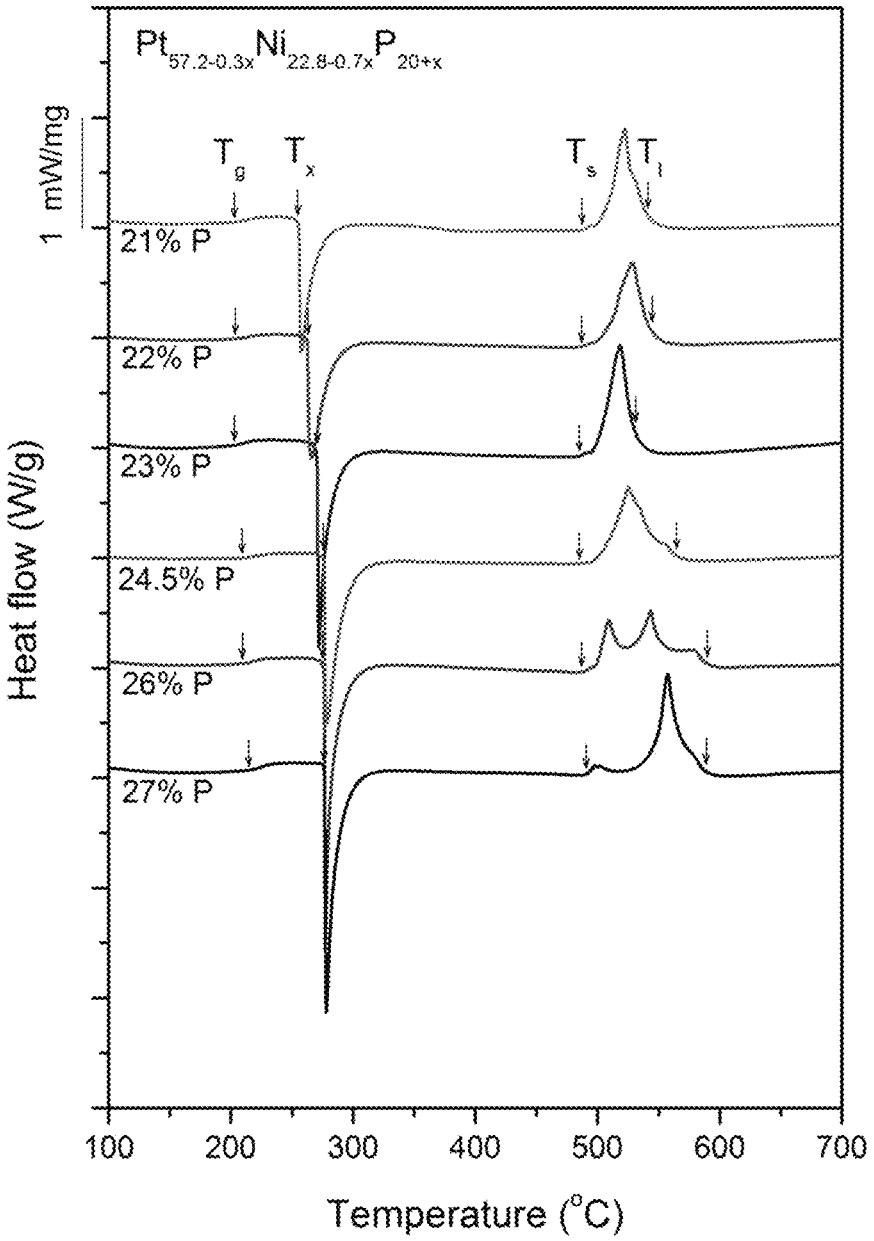
FIG. 2 provides calorimetry scans for sample metallic glasses $Pt_{57.2-0.3x}Ni_{22.8-0.7x}P_{20+x}$ in accordance with embodiments of the disclosure. The glass transition temperature $T_g$, crystallization temperature $T_x$, solidus temperature $T_s$, and liquidus temperature $T_l$ are indicated by arrows.

FIG. 2 provides calorimetry scans for sample metallic glasses according to $Pt_{57.2-0.3x}Ni_{22.8-0.7x}P_{20+x}$ in accordance with embodiments of the disclosure. The glass transition temperature $T_g$, crystallization temperature $T_x$, solidus temperature $T_s$, and liquidus temperature $T_l$ are indicated by arrows in FIG. 2, and are listed in Table 2. The difference between crystallization and glass-transition temperatures, $\Delta T_x = T_x - T_g$, is also listed in Table 2. As seen in FIG. 2 and Table 2, $T_g$ increases from 203.3 to 214.4° C. by increasing the P atomic fraction from 21 to 27 percent. On the other hand, $T_l$ fluctuates within the range of 530 to 544° C. when increasing the P atomic fraction from 21 to 23 percent, and then increases sharply to 588.4° C. as P is increased to 27 atomic percent.

TABLE 2

Sample metallic glasses demonstrating the effect of increasing the P atomic concentration according to the formula $Pt_{57.2-0.3x}Ni_{22.8-0.7x}P_{20+x}$ on the glass-transition, crystallization, solidus, and liquidus temperatures

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 1 | $Pt_{56.9}Ni_{22.1}P_{21}$ | 203.3 | 254.1 | 50.8 | 488.1 | 541.5 |
| 2 | $Pt_{56.6}Ni_{21.4}P_{22}$ | 203.8 | 262.5 | 58.7 | 488.0 | 543.6 |
| 4 | $Pt_{56.3}Ni_{20.7}P_{23}$ | 202.9 | 270.3 | 67.4 | 485.9 | 530.6 |
| 7 | $Pt_{55.8}Ni_{19.7}P_{24.5}$ | 209.0 | 276.3 | 67.3 | 483.4 | 565.2 |
| 9 | $Pt_{55.4}Ni_{18.6}P_{26}$ | 209.9 | 276.4 | 66.5 | 489.8 | 589.7 |
| 10 | $Pt_{55.1}Ni_{17.9}P_{27}$ | 214.4 | 276.6 | 62.2 | 491.4 | 588.4 |

Figure 3:
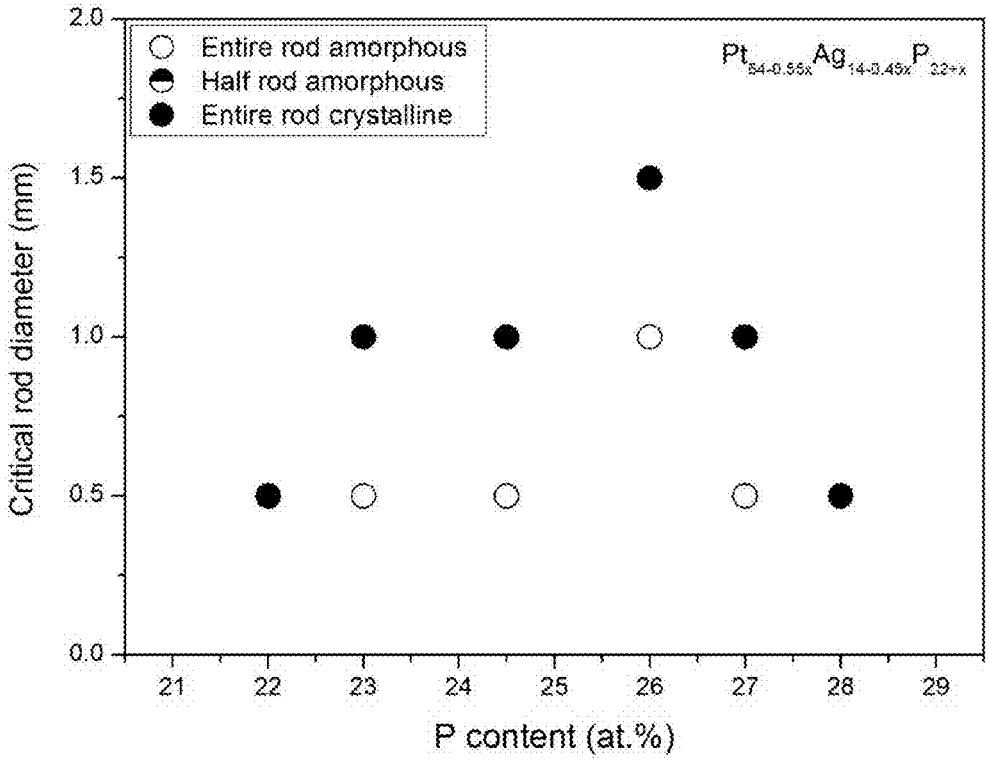
FIG. 3 provides a data plot showing the effect of varying the atomic fraction of P on the glass-forming ability of alloys satisfying the PT850 hallmark according to composition formula $Pt_{64-0.55x}Ag_{14-0.45x}P_{22+x}$.

Specific embodiments of metallic glasses formed of Pt—P alloys comprising Ag with compositions according to the formula $Pt_{64-0.55x}Ag_{14-0.45x}P_{22+x}$ with Pt weight fraction of at least 85.0 percent satisfying the PT850 hallmark are presented in Table 3. In these alloys, the atomic fraction of P varies from 22 to 28 percent, the atomic fraction of Ag varies from about 11 to 14 percent, and the atomic fraction of Pt varies from about 60 to 64 percent, while all alloys have weight fractions of Pt of at least 85.0 percent. The critical rod diameters of the example alloys along with the Pt weight percentage are also listed in Table 3. FIG. 3 provides a data plot showing the effect of varying the atomic fraction of P according to the composition formula $Pt_{64-0.55x}Ag_{14-0.45x}P_{22+x}$ on the glass-forming ability of the alloys.

TABLE 3

Sample metallic glasses demonstrating the effect of increasing the P atomic concentration according to the formula $Pt_{64-0.55x}Ag_{14-0.45x}P_{22+x}$ on the glass-forming ability of the alloys

| Example | Composition | Pt wt. % | Critical Rod Diameter [mm] |
|---|---|---|---|
| 11 | $Pt_{64}Ag_{14}P_{22}$ | 85.1 | <0.5 |
| 12 | $Pt_{63.5}Ag_{13.5}P_{23}$ | 85.1 | 0.5 |
| 13 | $Pt_{62.6}Ag_{12.9}P_{24.5}$ | 85.0 | 0.5 |
| 14 | $Pt_{61.8}Ag_{12.2}P_{26}$ | 85.0 | 1 |
| 15 | $Pt_{61.3}Ag_{11.7}P_{27}$ | 85.1 | 0.5 |
| 16 | $Pt_{60.7}Ag_{11.3}P_{28}$ | 85.0 | <0.5 |

As shown in Table 3 and FIG. 3, substituting Pt and Ag by P according to $Pt_{64-0.55x}Ag_{14-0.45x}P_{22+x}$ results in slightly varying glass-forming ability. Specifically, the critical rod diameter increases from less than 0.5 mm for the alloy containing 22 atomic percent P (Example 11) to 0.5 mm for the alloys containing 23-24.5 atomic percent P (Examples 12-13), reaches a peak of 1 mm for the alloy containing 26 atomic percent P (Example 14), decreases back to 0.5 mm for the alloy containing 27 atomic percent P (Example 15), and decreases further to less than 0.5 mm for the alloy containing 28 atomic percent P (Example 16).

Figure 4:
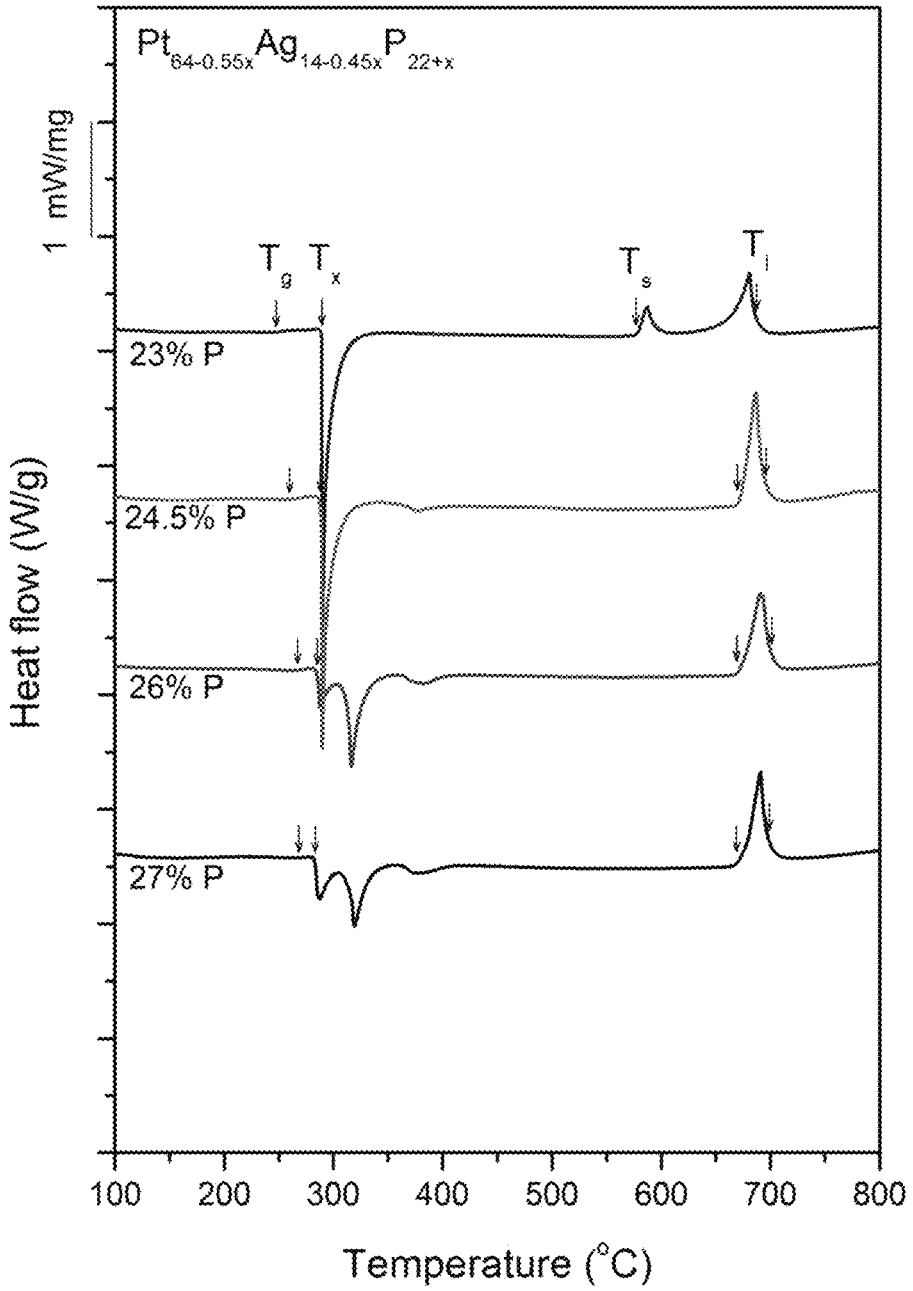
FIG. 4 provides calorimetry scans for sample metallic glasses $Pt_{64-0.55x}Ag_{14-0.45x}P_{22+x}$ in accordance with embodiments of the disclosure. The glass transition temperature $T_g$, crystallization temperature $T_x$, solidus temperature $T_s$, and liquidus temperature $T_l$ are indicated by arrows.

FIG. 4 provides calorimetry scans for sample metallic glasses according to $Pt_{64-0.55x}Ag_{14-0.45x}P_{22+x}$ in accordance with embodiments of the disclosure. The glass transition temperature $T_g$, crystallization temperature $T_x$, solidus temperature $T_s$, and liquidus temperature $T_l$ are indicated by arrows in FIG. 4, and are listed in Table 4. The difference between crystallization and glass-transition temperatures, $\Delta T_x = T_x - T_g$, is also listed in Table 4. As seen in FIG. 4 and Table 4, $T_g$ increases from 246.6 to 268.1° C. by increasing the P atomic fraction from 23 to 27 percent. On the other hand, $T_l$ increases slightly from 686 to 696.7° C. when increasing the P atomic fraction from 23 to 27 percent.

TABLE 4

Sample metallic glasses demonstrating the effect of increasing the P atomic concentration according to the formula $Pt_{64-0.55x}Ag_{14-0.45x}P_{22+x}$ on the glass-transition, crystallization, solidus, and liquidus temperatures

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 12 | $Pt_{63.5}Ag_{13.5}P_{23}$ | 246.6 | 289.0 | 42.4 | 578.3 | 686.0 |
| 13 | $Pt_{62.6}Ag_{12.9}P_{24.5}$ | 259.2 | 288.6 | 29.4 | 672.1 | 693.7 |
| 14 | $Pt_{61.8}Ag_{12.2}P_{26}$ | 267.6 | 285.2 | 17.6 | 670.8 | 699.8 |
| 15 | $Pt_{61.3}Ag_{11.7}P_{27}$ | 268.1 | 283.1 | 15.0 | 669.5 | 696.7 |

Figure 5:
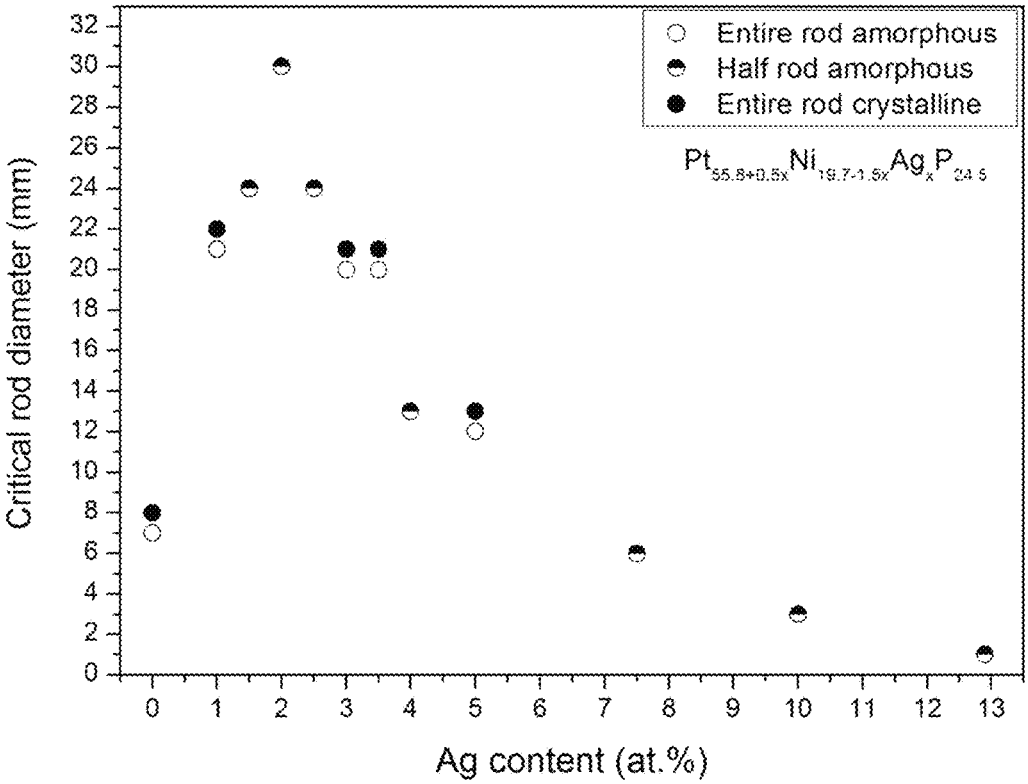
FIG. 5 provides a data plot showing the effect of varying the atomic fractions of Ni and Ag on the glass-forming ability of alloys satisfying the PT850 hallmark according to composition formula $Pt_{55.8+0.5x}Ni_{19.7-1.5x}Ag_xP_{24.5}$.

Specific embodiments of metallic glasses formed of Pt—P alloys comprising both Ni and Ag with compositions according to the formula $Pt_{55.8+0.5x}Ni_{19.7-1.5x}Ag_xP_{24.5}$ with Pt weight fraction of at least 85.0 percent satisfying the PT850 hallmark are presented in Table 5. In these alloys, the atomic fraction of Ni varies from about 4 to about 20 percent, the atomic fraction of Ag varies from 1 to about 13 percent, the atomic fraction of Pt varies from about 55 to about 68 percent, and the atomic fraction of P is constant at 24.5 percent, while all alloys have weight fractions of Pt of at least 85.0 percent. The critical rod diameters of the example alloys along with the Pt weight percentage are also listed in Table 5. FIG. 5 provides a data plot showing the effect of varying the atomic fractions of Ni and Ag according to the composition formula $Pt_{55.8+0.5x}Ni_{19.7-1.5x}Ag_xP_{24.5}$ on the glass-forming ability of the alloys.

TABLE 5

Sample metallic glasses demonstrating the effect of varying the Ni and Ag atomic concentrations according to the formula $Pt_{55.8+0.5x}Ni_{19.7-1.5x}Ag_xP_{24.5}$ on the glass-forming ability of the alloys

| Example | Composition | Pt wt. % | Critical Rod Diameter [mm] |
|---|---|---|---|
| 7 | $Pt_{55.8}Ni_{19.7}P_{24.5}$ | 85.0 | 7 |
| 17 | $Pt_{56.3}Ni_{18.2}Ag_1P_{24.5}$ | 85.0 | 21 |
| 18 | $Pt_{56.6}Ni_{17.4}Ag_{1.5}P_{24.5}$ | 85.0 | 24 |
| 19 | $Pt_{56.9}Ni_{16.6}Ag_2P_{24.5}$ | 85.1 | 30 |
| 20 | $Pt_{57.2}Ni_{15.8}Ag_{2.5}P_{24.5}$ | 85.1 | 24 |
| 21 | $Pt_{57.4}Ni_{15.1}Ag_3P_{24.5}$ | 85.0 | 20 |
| 22 | $Pt_{57.7}Ni_{14.3}Ag_{3.5}P_{24.5}$ | 85.1 | 20 |
| 23 | $Pt_{57.9}Ni_{13.6}Ag_4P_{24.5}$ | 85.0 | 13 |
| 24 | $Pt_{58.4}Ni_{12.1}Ag_5P_{24.5}$ | 85.0 | 12 |
| 25 | $Pt_{59.7}Ni_{8.3}Ag_{7.5}P_{24.5}$ | 85.0 | 6 |
| 26 | $Pt_{61.1}Ni_{4.4}Ag_{10}P_{24.5}$ | 85.0 | 3 |
| 13 | $Pt_{62.6}Ag_{12.9}P_{24.5}$ | 85.0 | 0.5 |

As shown in Table 5 and FIG. 5, substituting Ni by Ag in $Pt_{55.8}Ni_{19.7}P_{24.5}$ or substituting Ag by Ni in $Pt_{62.6}Ag_{12.9}P_{24.5}$ according to $Pt_{55.8+0.5x}Ni_{19.7-1.5x}Ag_xP_{24.5}$ improves glass-forming ability. Specifically, the critical rod diameter of the quaternary alloy is shown to increase from 7 mm for the ternary $Pt_{55.8}Ni_{19.7}P_{24.5}$ (Example 7), to a peak value of 30 mm for alloy $Pt_{56.9}Ni_{16.6}Ag_2P_{24.5}$ (Example 19), and back to 0.5 mm for the ternary $Pt_{62.6}Ag_{12.9}P_{24.5}$ (Example 13). As seen in Table 5 and FIG. 5, by including just 1 atomic percent of Ag in $Pt_{55.8}Ni_{19.7}P_{24.5}$, the critical rod diameter increases from 7 mm to 21 mm, i.e. by a factor of 3. On the other end, by including just 4.4 atomic percent of Ni in $Pt_{62.6}Ag_{12.9}P_{24.5}$, the critical rod diameter increases from 0.5 mm to 3 mm, i.e. by a factor of 6. The peak critical rod diameter of 30 mm for alloy $Pt_{56.9}Ni_{16.6}Ag_2P_{24.5}$ (Example 19) is greater than that for ternary $Pt_{55.8}Ni_{19.7}P_{24.5}$ (Example 7) by a factor of more than 4, and greater than that for ternary $Pt_{62.6}Ag_{12.9}P_{24.5}$ (Example 13) by a factor of 60.

Figure 6:
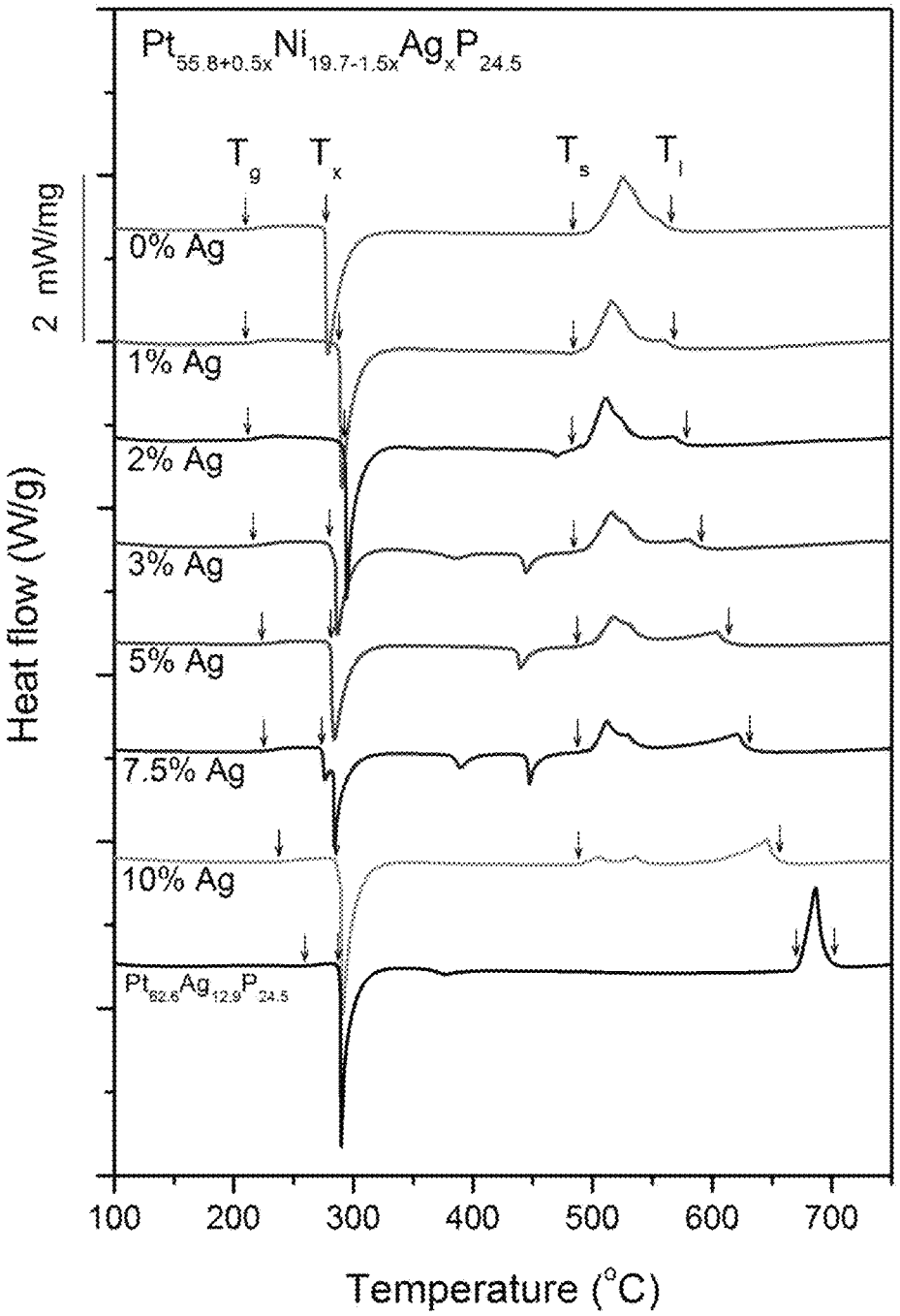
FIG. 6 provides calorimetry scans for sample metallic glasses $Pt_{55.8+0.5x}Ni_{19.7-1.5x}Ag_xP_{24.5}$ in accordance with embodiments of the disclosure. The glass transition temperature $T_g$, crystallization temperature $T_x$, solidus temperature $T_s$, and liquidus temperature $T_l$ are indicated by arrows.

FIG. 6 provides calorimetry scans for sample metallic glasses according to $Pt_{55.8+0.5x}Ni_{19.7-1.5x}Ag_xP_{24.5}$ in accordance with embodiments of the disclosure. The glass transition temperature $T_g$, crystallization temperature $T_x$, solidus temperature $T_s$, and liquidus temperature $T_l$ are indicated by arrows in FIG. 6, and are listed in Table 6. The difference between crystallization and glass-transition temperatures, $\Delta T_x = T_x - T_g$, is also listed in Table 6. As seen in FIG. 6 and Table 6, by substituting Ni with Ag, $T_g$ increases monotonically from 209° C. for the ternary $Pt_{55.8}Ni_{19.7}P_{24.5}$ (Example 7) to 259.2° C. for ternary $Pt_{62.6}Ag_{12.9}P_{24.5}$ (Example 13). Also, by substituting Ni by Ag, $T_l$ likewise increases monotonically from 565.2° C. for the ternary $Pt_{55.8}Ni_{19.7}P_{24.5}$ (Example 7) to 693.7° C. for ternary $Pt_{62.6}Ag_{12.9}P_{24.5}$ (Example 13).

TABLE 6

Sample metallic glasses demonstrating the effect of varying the atomic fractions of Ni and Ag according to the formula $Pt_{55.8+0.5x}Ni_{19.7-1.5x}Ag_xP_{24.5}$ on the glass-transition, crystallization, solidus, and liquidus temperatures of the alloys

| Example | Composition | $T_g$ (° C.) | $T_x$ (° C.) | $\Delta T_x$ (° C.) | $T_s$ (° C.) | $T_l$ (° C.) |
|---|---|---|---|---|---|---|
| 7 | $Pt_{55.8}Ni_{19.7}P_{24.5}$ | 209.0 | 276.3 | 67.3 | 483.4 | 565.2 |
| 17 | $Pt_{56.3}Ni_{18.2}Ag_1P_{24.5}$ | 210.1 | 288.2 | 78.1 | 484.0 | 569.6 |
| 19 | $Pt_{56.9}Ni_{16.6}Ag_2P_{24.5}$ | 212.0 | 293.0 | 81.0 | 484.1 | 577.0 |
| 21 | $Pt_{57.4}Ni_{15.1}Ag_3P_{24.5}$ | 216.4 | 279.3 | 62.9 | 485.2 | 589.1 |
| 24 | $Pt_{58.4}Ni_{12.1}Ag_5P_{24.5}$ | 223.4 | 279.6 | 56.2 | 489.7 | 612.5 |
| 25 | $Pt_{59.7}Ni_{8.3}Ag_{7.5}P_{24.5}$ | 225.1 | 273.9 | 48.8 | 489.7 | 629.0 |
| 26 | $Pt_{61.1}Ni_{4.4}Ag_{10}P_{24.5}$ | 237.7 | 285.2 | 47.5 | 488.8 | 653.1 |
| 13 | $Pt_{62.6}Ag_{12.9}P_{24.5}$ | 259.2 | 288.6 | 29.4 | 672.1 | 693.7 |

Figure 7:
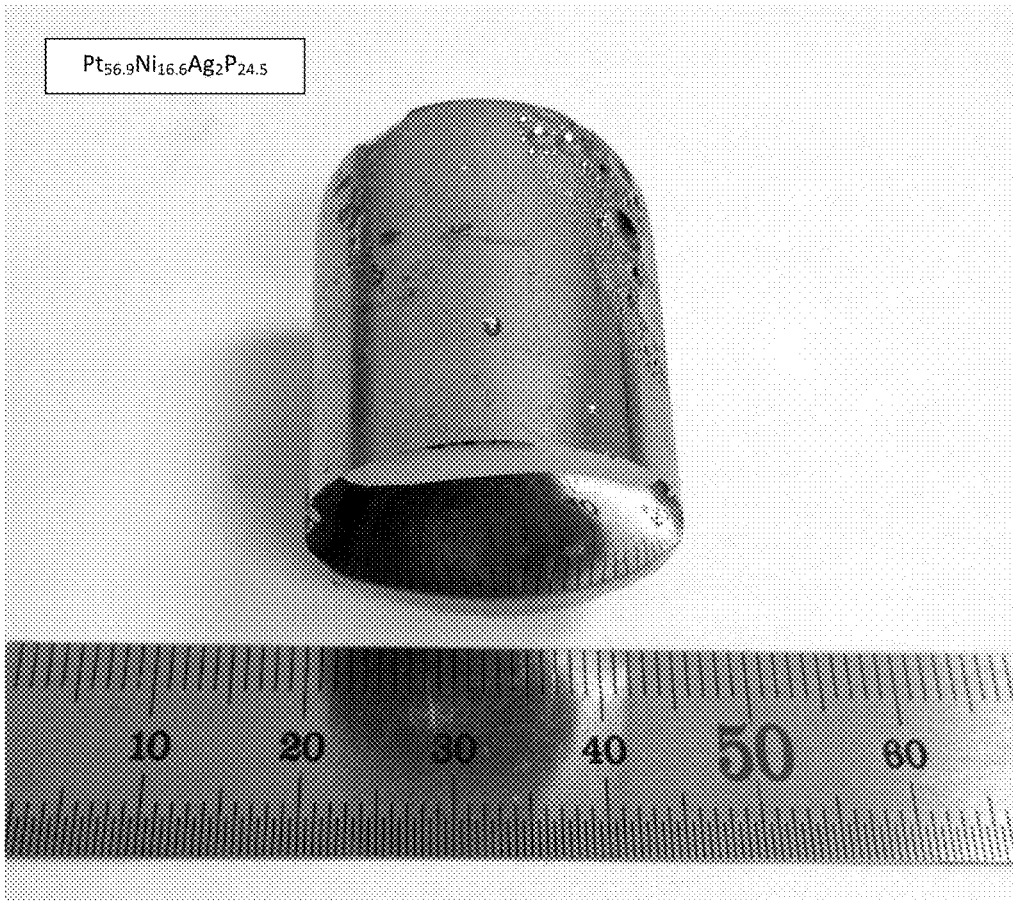
FIG. 7 provides an image of a 26-mm diameter metallic glass rod with composition $Pt_{56.0}Ni_{16.6}Ag_2P_{24.5}$ (Example 19).
Figure 8:
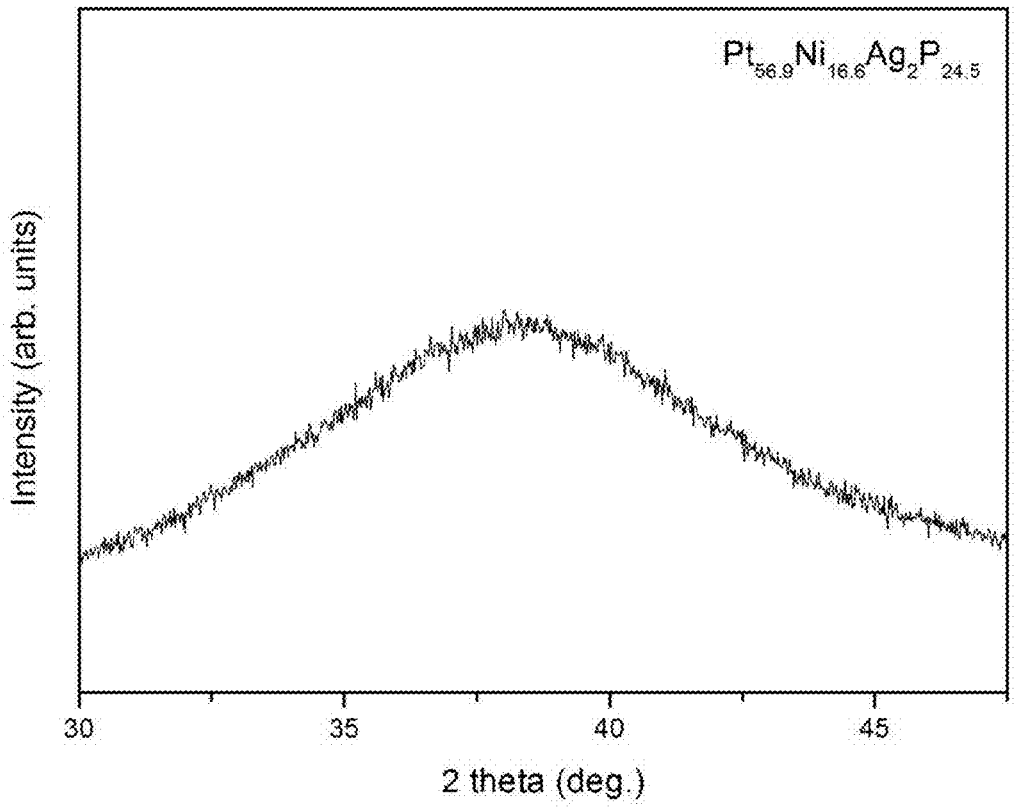
FIG. 8 provides an x-ray diffractogram verifying the amorphous structure of a 26-mm diameter metallic glass rod with composition $Pt_{56.0}Ni_{16.6}Ag_2P_{24.5}$ (Example 19).

As shown in Tables 5 and 6 and FIGS. 5 and 6, alloy $Pt_{56.9}Ni_{16.6}Ag_2P_{24.5}$ (Example 19) has the highest glass-forming ability among Pt—Ni—Ag—P alloys that satisfy the PT850 hallmark. FIG. 7 provides an image of a 26-mm diameter metallic glass rod with composition $Pt_{56.9}Ni_{16.6}Ag_2P_{24.5}$. FIG. 8 provides an x-ray diffractogram verifying the amorphous structure of a 26-mm diameter metallic glass rod with composition $Pt_{56.9}Ni_{16.6}Ag_2P_{24.5}$. The Vickers hardness (HV05) of sample metallic glass $Pt_{56.9}Ni_{16.6}Ag_2P_{24.5}$ (Example 19) is measured to be 422.7±3.6 Kgf/mm$^2$.

Description of Pd- and Ag-Bearing Pt—P Alloys and Metallic Glass Compositions

In some embodiments, the disclosure is directed to Pt—P alloys and metallic glasses that also bear Pd and Ag. In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 15 to 30 percent. The alloy also comprises Pd and Ag, where the atomic fraction of Pd and Ag is each in the range of 0.1 to 30 percent. Among other additional elements, the alloy may additionally comprise Cu in an atomic fraction of less than 2 percent. The critical rod diameter of the alloy is at least 3 mm.

In another embodiment, the atomic fraction of Pt is in the range of 50 to 65 percent, the atomic fraction of P is in the range of 20 to 28 percent, the atomic fraction of Pd and Ag is each in the range of 0.1 to 23 percent, and wherein the Pt weight fraction is at least 85.0 percent.

In another embodiment, the disclosure is directed to an alloy capable of forming a metallic glass having a composition represented by the following formula (subscripts denote atomic percentages):

$$Pt_{(100-a-b-c)}Pd_aAg_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In another embodiment, a ranges from 2 to 12, b ranges from 0.1 to 10, c ranges from 18 to 25, and the Pt weight fraction is at least 85.0 percent.

To illustrate the effects of including both Pd and Ag in Pt—P alloys in terms of enhancing glass-forming ability, glass-forming ability data for Pt—P alloys that include both Pd and Ag are compared against Pt—P alloys that include only one of Pd and Ag. It is demonstrated that by adding Ag in Pt—Pd—P alloys, or by adding Pd in Pt—Ag—P alloys, the glass-forming ability of the quaternary alloys improve over the ternary alloys. It is also demonstrated that a certain Pd/Ag combination exists where a peak in glass-forming ability is reached in Pt—Pd—Ag—P alloys. At this peak, the critical rod diameter is many times larger than the critical rod diameter of the two ternary alloys Pt—Pd—P and Pt—Ag—P.

Figure 9:
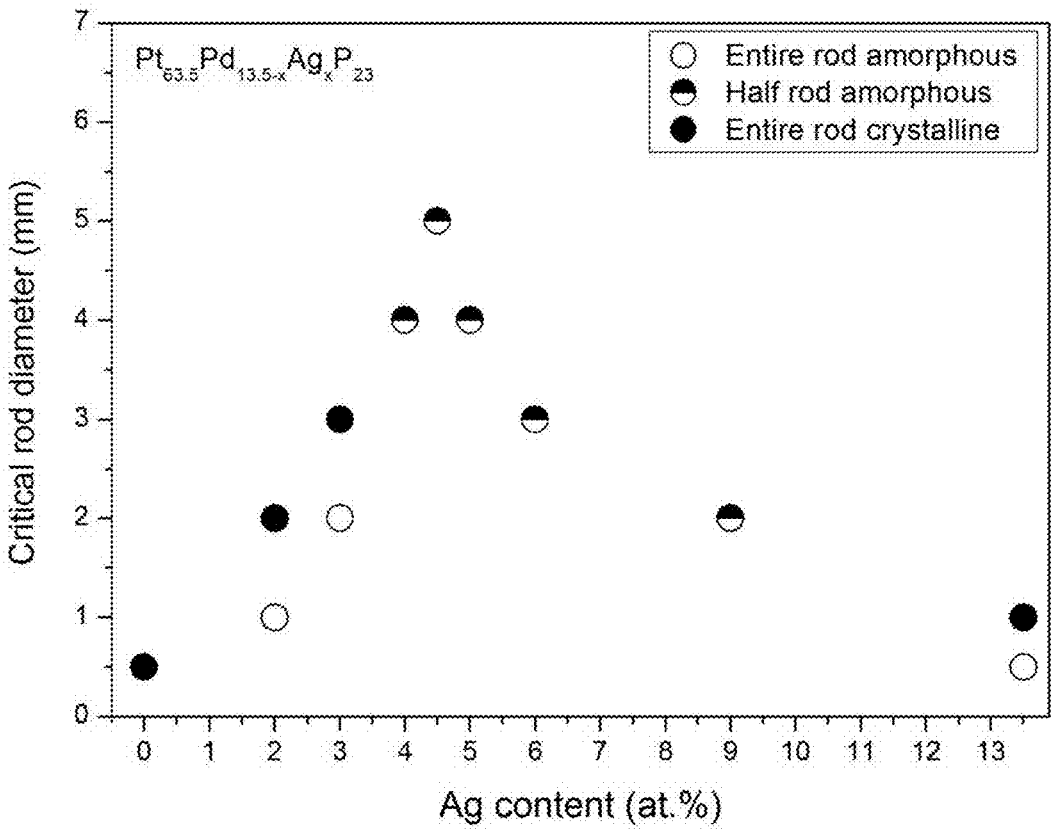
FIG. 9 provides a data plot showing the effect of varying the atomic fractions of Pd and Ag according to the composition formula $Pt_{63.5}Pd_{13.5-x}Ag_xP_{23}$ on the glass-forming ability of the alloys.

Specific embodiments of metallic glasses formed of Pt—P alloys comprising both Pd and Ag with compositions according to the formula $Pt_{63.5}Pd_{13.5-x}Ag_xP_{23}$ with Pt weight fraction of at least 85.0 percent satisfying the PT850 hallmark are presented in Table 7. In these alloys, the atomic fraction of Pd varies from about 4 to about 13.5 percent, the atomic fraction of Ag varies from 1 to about 13.5 percent, the atomic fraction of Pt is constant at 63.5 percent, and the atomic fraction of P is constant at 23 percent, while all alloys have weight fractions of Pt of at least 85.0 percent. The critical rod diameters of the example alloys along with the Pt weight percentage are also listed in Table 7. FIG. 9 provides a data plot showing the effect of varying the atomic fractions of Pd and Ag according to the composition formula $Pt_{63.5}Pd_{13.5-x}Ag_xP_{23}$ on the glass-forming ability of the alloys.

TABLE 7

Sample metallic glasses demonstrating the effect of varying the Ni and Ag atomic concentrations according to the formula $Pt_{63.5}Pd_{13.5-x}Ag_xP_{23}$ on the glass-forming ability of the alloys

| Example | Composition | Pt wt. % | Critical Rod Diameter [mm] |
|---|---|---|---|
| 27 | $Pt_{63.5}Pd_{13.5}P_{23}$ | 85.2 | <0.5 |
| 28 | $Pt_{63.5}Pd_{11.5}Ag_2P_{23}$ | 85.2 | 1 |
| 29 | $Pt_{63.5}Pd_{10.5}Ag_3P_{23}$ | 85.2 | 2 |
| 30 | $Pt_{63.5}Pd_{9.5}Ag_4P_{23}$ | 85.2 | 4 |
| 31 | $Pt_{63.5}Pd_9Ag_{4.5}P_{23}$ | 85.2 | 5 |
| 32 | $Pt_{63.5}Pd_{8.5}Ag_5P_{23}$ | 85.2 | 4 |
| 33 | $Pt_{63.5}Pd_{7.5}Ag_6P_{23}$ | 85.2 | 3 |
| 34 | $Pt_{63.5}Pd_{4.5}Ag_9P_{23}$ | 85.1 | 2 |
| 12 | $Pt_{63.5}Ag_{13.5}P_{23}$ | 85.1 | 0.5 |

As shown in Table 7 and FIG. 9, substituting Pd by Ag in $Pt_{63.5}Pd_{13}P_{23}$ or substituting Ag by Pd in $Pt_{63.5}Ag_{13.5}P_{23}$ according to $Pt_{63.5}Pd_{13.5-x}Ag_xP_{23}$ improves glass-forming ability. Specifically, the critical rod diameter of the quaternary alloy is shown to increase from less than 0.5 mm for the ternary $Pt_{63.5}Pd_{13}P_{23}$ (Example 27), to a peak value of 5 mm for alloy $Pt_{63.5}Pd_9Ag_{4.5}P_{23}$ (Example 31), and back to 0.5 mm for the ternary $Pt_{63.5}Ag_{13.5}P_{23}$ (Example 12). The peak critical rod diameter of 5 mm for alloy $Pt_{63.5}Pd_9Ag_{4.5}P_{23}$ (Example 31) is greater than that for ternaries $Pt_{63.5}Pd_{13}P_{23}$ (Example 27) and $Pt_{63.5}Ag_{13.5}P_{23}$ (Example 12) by a factor of 10 or more.

Figure 10:
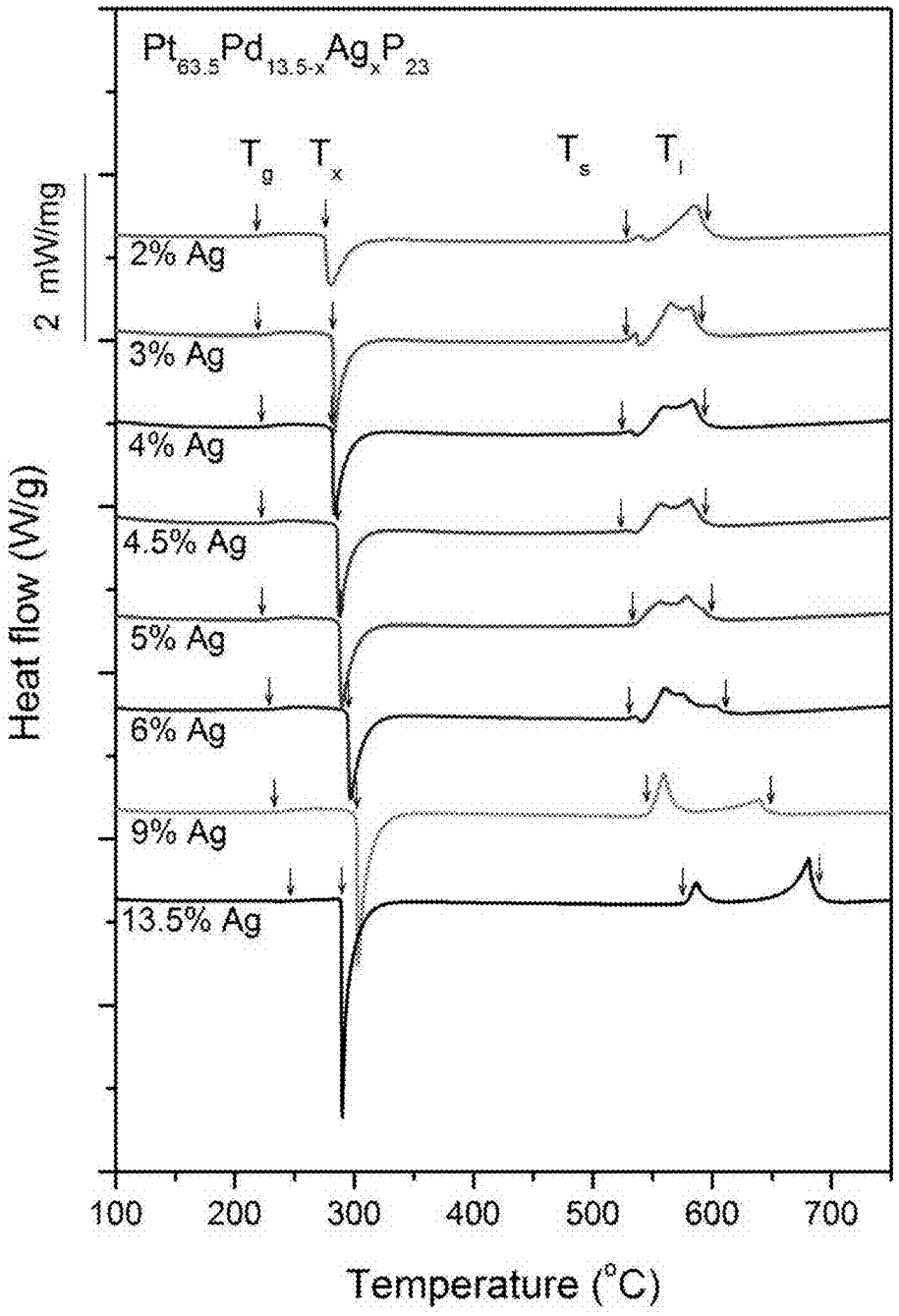
FIG. 10 provides calorimetry scans for sample metallic glasses according to $Pt_{63.5}Pd_{13.5-x}Ag_xP_{23}$ in accordance with embodiments of the disclosure. The glass transition temperature $T_g$, crystallization temperature $T_x$, solidus temperature $T_s$, and liquidus temperature $T_l$ are indicated by arrows.

FIG. 10 provides calorimetry scans for sample metallic glasses according to $Pt_{63.5}Pd_{13.5-x}Ag_xP_{23}$ in accordance with embodiments of the disclosure. The glass transition temperature $T_g$, crystallization temperature $T_x$, solidus temperature $T_s$, and liquidus temperature $T_l$ are indicated by arrows in FIG. 10, and are listed in Table 8. The difference between crystallization and glass-transition temperatures, $\Delta T_x = T_x - T_g$, is also listed in Table 8. As seen in FIG. 10 and Table 8, by substituting Pd with Ag, $T_g$ increases monotonically from 218.2° C. for $Pt_{63.5}Pd_{11.5}Ag_2P_{23}$ (Example 28) to 246.6° C. for ternary $Pt_{63.5}Ag_{13.5}P_{23}$ (Example 12). Also, by substituting Pd by Ag, $T_l$ likewise increases monotonically from 597.1° C. for $Pt_{63.5}Pd_{11.5}Ag_2P_{23}$ (Example 28) to 686.0° C. for ternary $Pt_{63.5}Ag_{13.5}P_{23}$ (Example 12).

TABLE 8

Sample metallic glasses demonstrating the effect of varying the atomic fractions of Pd and Ag according to the formula $Pt_{63.5}Pd_{13.5-x}Ag_xP_{23}$ on the glass-transition, crystallization, solidus, and liquidus temperatures of the alloys

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 28 | $Pt_{63.5}Pd_{11.5}Ag_2P_{23}$ | 218.2 | 275.6 | 57.4 | 528.8 | 597.1 |
| 29 | $Pt_{63.5}Pd_{10.5}Ag_3P_{23}$ | 218.8 | 281.1 | 62.3 | 528.0 | 590.7 |
| 30 | $Pt_{63.5}Pd_{9.5}Ag_4P_{23}$ | 221.5 | 281.8 | 60.3 | 523.6 | 594.0 |
| 31 | $Pt_{63.5}Pd_9Ag_{4.5}P_{23}$ | 222.2 | 284.7 | 62.5 | 522.5 | 595.2 |
| 32 | $Pt_{63.5}Pd_{8.5}Ag_5P_{23}$ | 222.6 | 287.1 | 64.5 | 526.4 | 600.7 |
| 33 | $Pt_{63.5}Pd_{7.5}Ag_6P_{23}$ | 228.5 | 294.1 | 65.6 | 521.5 | 611.4 |
| 34 | $Pt_{63.5}Pd_{4.5}Ag_9P_{23}$ | 232.7 | 301.2 | 68.5 | 542.0 | 646.9 |
| 12 | $Pt_{63.5}Ag_{13.5}P_{23}$ | 246.6 | 289.0 | 42.4 | 578.3 | 686.0 |

Figure 11:
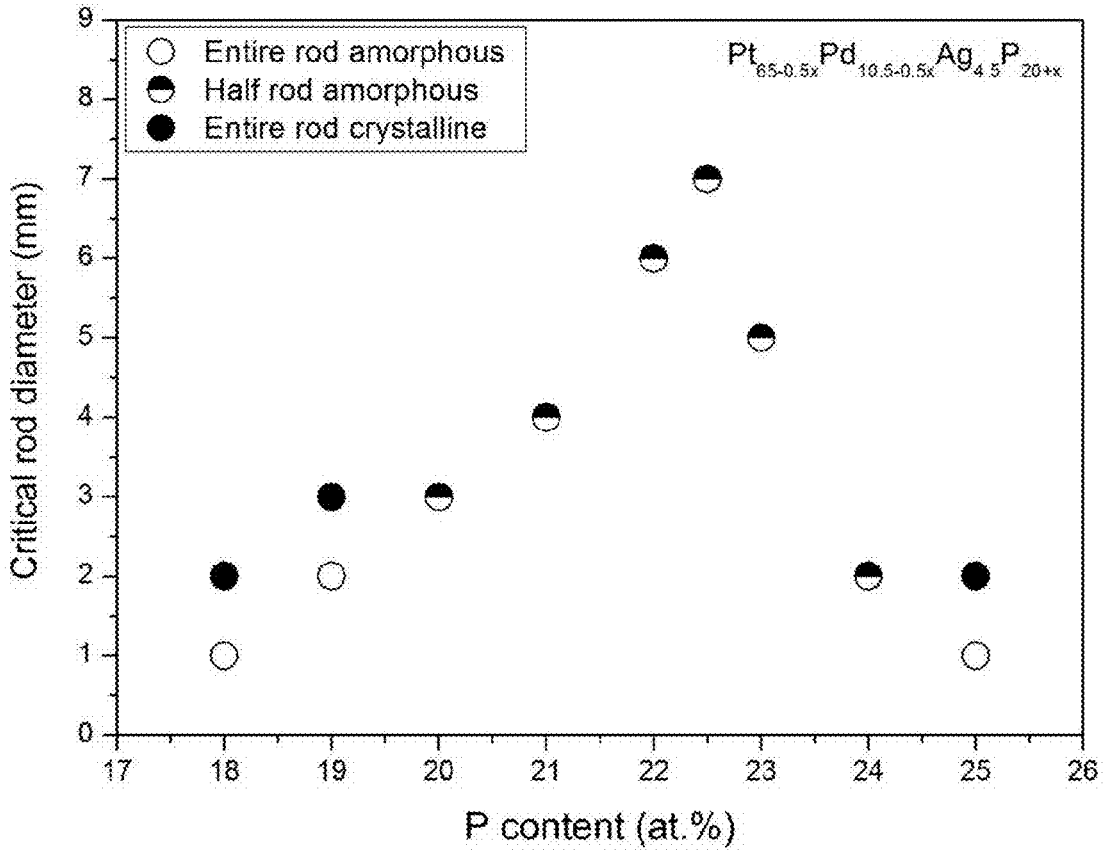
FIG. 11 provides a data plot showing the effect of varying the atomic fractions of Pt, Pd, and P according to the composition formula $Pt_{65-0.5x}Pd_{10.5-0.5x}Ag_{4.5}P_{20+x}$ on the glass-forming ability of the alloys.

Specific embodiments of metallic glasses formed of Pt—P alloys comprising both Pd and Ag with compositions according to the formula $Pt_{65-0.5x}Pd_{10.5-0.5x}Ag_{4.5}P_{20+x}$ with Pt weight fraction of at least 85.0 percent satisfying the PT850 hallmark are presented in Table 9. In these alloys, the atomic fraction of Pd varies from 8 to about 11.5 percent, the atomic fraction of Ag is constant at 4.5 percent, the atomic fraction of Pt varies from 62.5 to 66 percent, and the atomic fraction of P varies from 18 to 25 percent, while all alloys have weight fractions of Pt of at least 85.0 percent. The critical rod diameters of the example alloys along with the Pt weight percentage are also listed in Table 9. FIG. 11 provides a data plot showing the effect of varying the atomic fractions of Pt, Pd, and P according to the composition formula $Pt_{65-0.5x}Pd_{10.5-0.5x}Ag_{4.5}P_{20+x}$ on the glass-forming ability of the alloys.

TABLE 9

Sample metallic glasses demonstrating the effect of increasing the P atomic concentration according to the formula $Pt_{65-0.5x}Pd_{10.5-0.5x}Ag_{4.5}P_{20+x}$ on the glass-forming ability of the alloys

| Example | Composition | Pt wt. % | Critical Rod Diameter [mm] |
|---|---|---|---|
| 35 | $Pt_{66}Pd_{11.5}Ag_{4.5}P_{18}$ | 85.0 | 1 |
| 36 | $Pt_{65.5}Pd_{11}Ag_{4.5}P_{19}$ | 85.1 | 2 |
| 37 | $Pt_{65}Pd_{10.5}Ag_{4.5}P_{20}$ | 85.1 | 3 |
| 38 | $Pt_{64.5}Pd_{10}Ag_{4.5}P_{21}$ | 85.1 | 4 |
| 39 | $Pt_{64}Pd_{9.5}Ag_{4.5}P_{22}$ | 85.1 | 6 |
| 40 | $Pt_{63.75}Pd_{9.25}Ag_{4.5}P_{22.5}$ | 85.2 | 7 |
| 31 | $Pt_{63.5}Pd_9Ag_{4.5}P_{23}$ | 85.2 | 5 |

TABLE 9-continued

Sample metallic glasses demonstrating the effect of increasing the P atomic concentration according to the formula $Pt_{65-0.5x}Pd_{10.5-0.5x}Ag_{4.5}P_{20+x}$ on the glass-forming ability of the alloys

| Example | Composition | Pt wt. % | Critical Rod Diameter [mm] |
|---|---|---|---|
| 41 | $Pt_{63}Pd_{8.5}Ag_{4.5}P_{24}$ | 85.2 | 2 |
| 42 | $Pt_{62.5}Pd_8Ag_{4.5}P_{25}$ | 85.2 | 1 |

As shown in Table 9 and FIG. 11, by substituting Pd and Pt by P according to $Pt_{65-0.5x}Pd_{10.5-0.5x}Ag_{4.5}P_{20+x}$, the glass-forming ability is improved. Specifically, the critical rod diameter is shown to increase from 1 mm for alloy $Pt_{66}Pd_{11.5}Ag_{4.5}P_{18}$ (Example 35) containing 18 atomic percent P, to a peak value of 7 mm for alloy $Pt_{63.75}Pd_{9.25}Ag_{4.5}P_{22.5}$ (Example 40)) containing 22.5 atomic percent P, and back to 1 mm for alloy $Pt_{62.5}Pd_8Ag_{4.5}P_{25}$ (Example 42) containing 25 atomic percent P.

Figure 12:
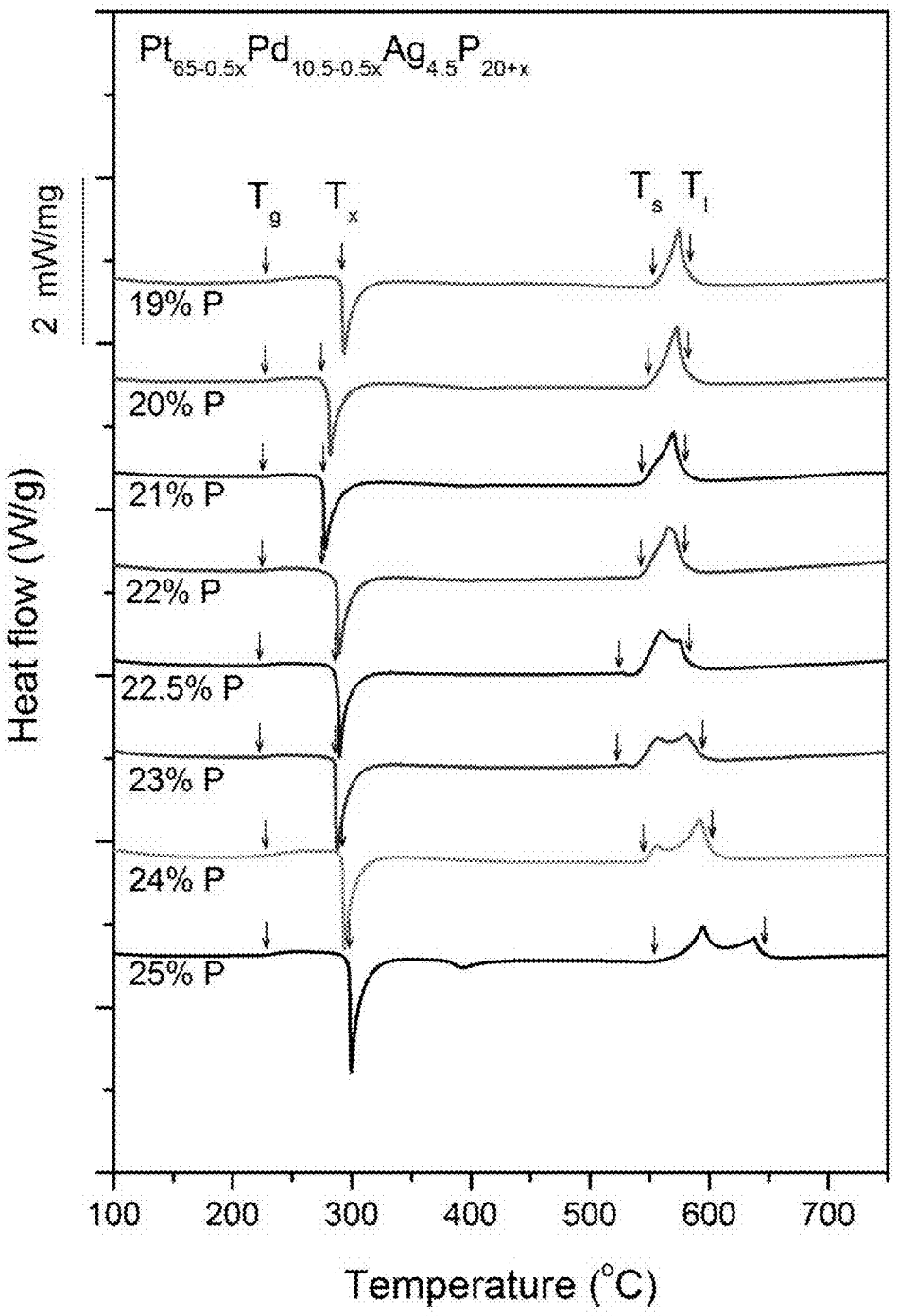
FIG. 12 provides calorimetry scans for sample metallic glasses according to $Pt_{65-0.5x}Pd_{10.5-0.5x}Ag_{4.5}P_{20+x}$ in accordance with embodiments of the disclosure. The glass transition temperature $T_g$, crystallization temperature $T_x$, solidus temperature $T_s$, and liquidus temperature $T_l$ are indicated by arrows.

FIG. 12 provides calorimetry scans for sample metallic glasses according to $Pt_{65-0.5x}Pd_{10.5-0.5x}Ag_{4.5}P_{20+x}$ in accordance with embodiments of the disclosure. The glass transition temperature $T_g$, crystallization temperature $T_x$, solidus temperature $T_s$, and liquidus temperature $T_l$ are indicated by arrows in FIG. 12, and are listed in Table 10. The difference between crystallization and glass-transition temperatures, $\Delta T = T_x - T_g$, is also listed in Table 10. As seen in FIG. 12 and Table 10, by substituting Pt and Pd with P, $T_g$ decreases from 227.1° C. for $Pt_{65.5}Pd_{11}Ag_{4.5}P_{19}$ (Example 36), reaches a minimum at about 222° C. for alloys $Pt_{63.5}Pd_9Ag_{4.5}P_{23}$ and $Pt_{63.75}Pd_{9.25}Ag_{4.5}P_{22.5}$ (Examples 31 and 40), and increases back to 228.1° C. for alloy $Pt_{62.5}Pd_8Ag_{4.5}P_{25}$ (Example 42). Also, by substituting Pt and Pd by P, $T_l$ remains constant at about 580° C. for alloys containing 19 to 23 atomic percent P (Example 36-40 and 31) and then increases monotonically with increasing P reaching 644.2° C. for alloy $Pt_{62.5}Pd_8Ag_{4.5}P_{25}$ (Example 42).

TABLE 10

Sample metallic glasses demonstrating the effect of varying the atomic fractions of Pt, Pd and P according to the formula $Pt_{65-0.5x}Pd_{10.5-0.5x}Ag_{4.5}P_{20+x}$ on the glass-transition, crystallization, solidus, and liquidus temperatures of the alloys

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 36 | $Pt_{65.5}Pd_{11}Ag_{4.5}P_{19}$ | 227.1 | 291.0 | 63.9 | 553.5 | 580.7 |
| 37 | $Pt_{65}Pd_{10.5}Ag_{4.5}P_{20}$ | 226.4 | 273.5 | 47.1 | 548.2 | 579.3 |
| 38 | $Pt_{64.5}Pd_{10}Ag_{4.5}P_{21}$ | 224.9 | 274.5 | 49.6 | 543.9 | 577.3 |
| 39 | $Pt_{64}Pd_{9.5}Ag_{4.5}P_{22}$ | 224.4 | 272.5 | 48.1 | 543.3 | 579.1 |
| 40 | $Pt_{63.75}Pd_{9.25}Ag_{4.5}P_{22.5}$ | 222.4 | 287.2 | 64.8 | 525.4 | 582.7 |
| 31 | $Pt_{63.5}Pd_9Ag_{4.5}P_{23}$ | 222.2 | 284.7 | 62.5 | 522.5 | 595.2 |
| 41 | $Pt_{63}Pd_{8.5}Ag_{4.5}P_{24}$ | 227.4 | 291.7 | 64.3 | 546.3 | 602.8 |
| 42 | $Pt_{62.5}Pd_8Ag_{4.5}P_{25}$ | 228.1 | 297.3 | 69.2 | 555.2 | 644.2 |

Other metallic glasses according to embodiments of the disclosure with Pt weight fraction of at least 85.0 percent satisfying the PT850 hallmark are presented in Table 11. The critical rod diameters of the example alloys along with the Pt weight percentage are also listed in Table 11.

TABLE 11

Other metallic glasses according to embodiments of the disclosure

| Example | Composition | Pt wt. % | Critical Rod Diameter [mm] |
|---|---|---|---|
| 43 | $Pt_{64.5}Pd_{8.5}Ag_{4.5}P_{22.5}$ | 85.8 | 7 |
| 44 | $Pt_{64.75}Pd_{8.5}Ag_{4.5}P_{22.25}$ | 85.9 | 8 |
| 45 | $Pt_{65}Pd_{8.5}Ag_{4.5}P_{22}$ | 86.0 | 9 |
| 46 | $Pt_{65.25}Pd_{8.25}Ag_{4.5}P_{22}$ | 86.2 | 9 |
| 47 | $Pt_{65.5}Pd_{8}Ag_{4.5}P_{22}$ | 86.4 | 9 |
| 48 | $Pt_{66}Pd_{7.5}Ag_{4.5}P_{22}$ | 86.8 | 8 |

Figure 13:
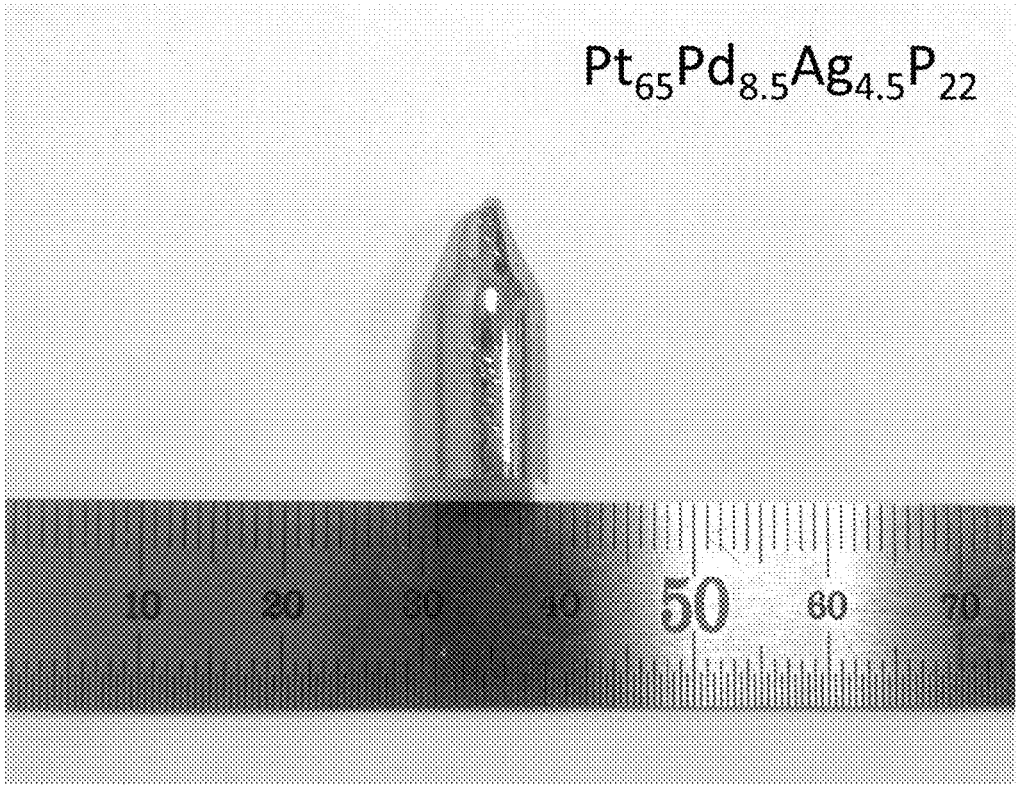
FIG. 13 provides an image of a 9 mm diameter metallic glass rod with composition $Pt_{65}Pd_{8.5}Ag_{4.5}P_{22}$ (Example 45).
Figure 14:
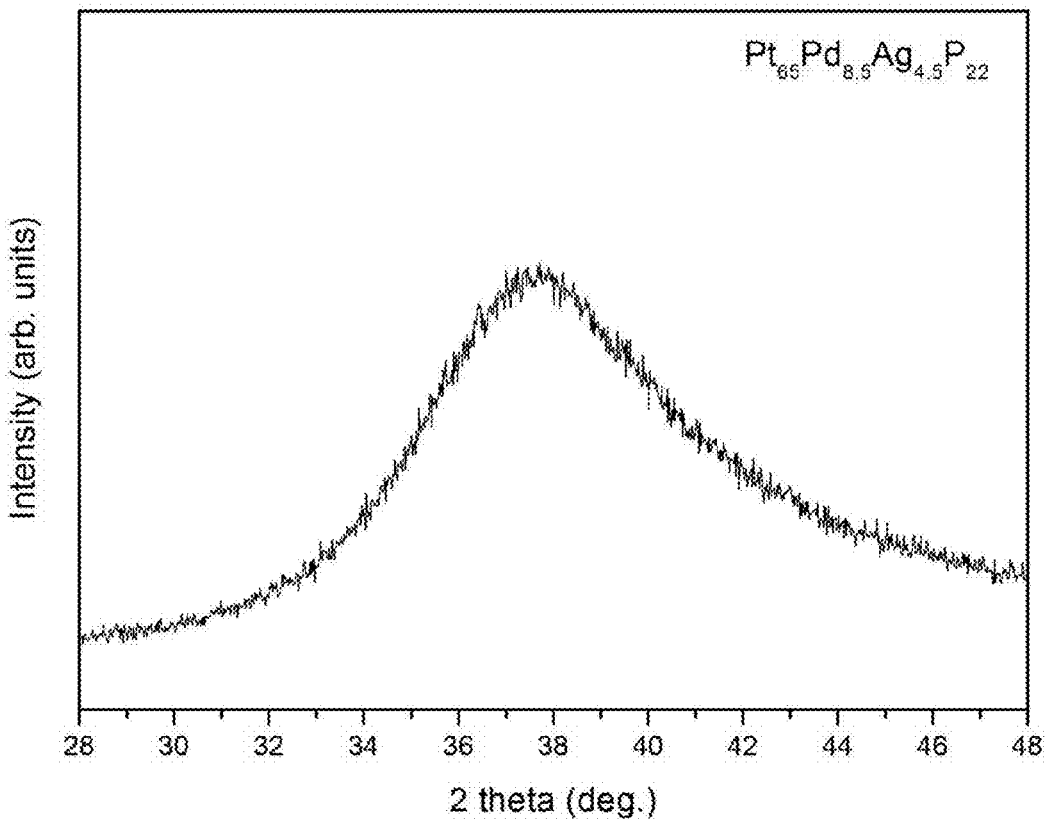
FIG. 14 provides an x-ray diffractogram verifying the amorphous structure of a 9 mm diameter metallic glass rod with composition $Pt_{65}Pd_{8.5}Ag_{4.5}P_{22}$ (Example 45).
Figure 15:
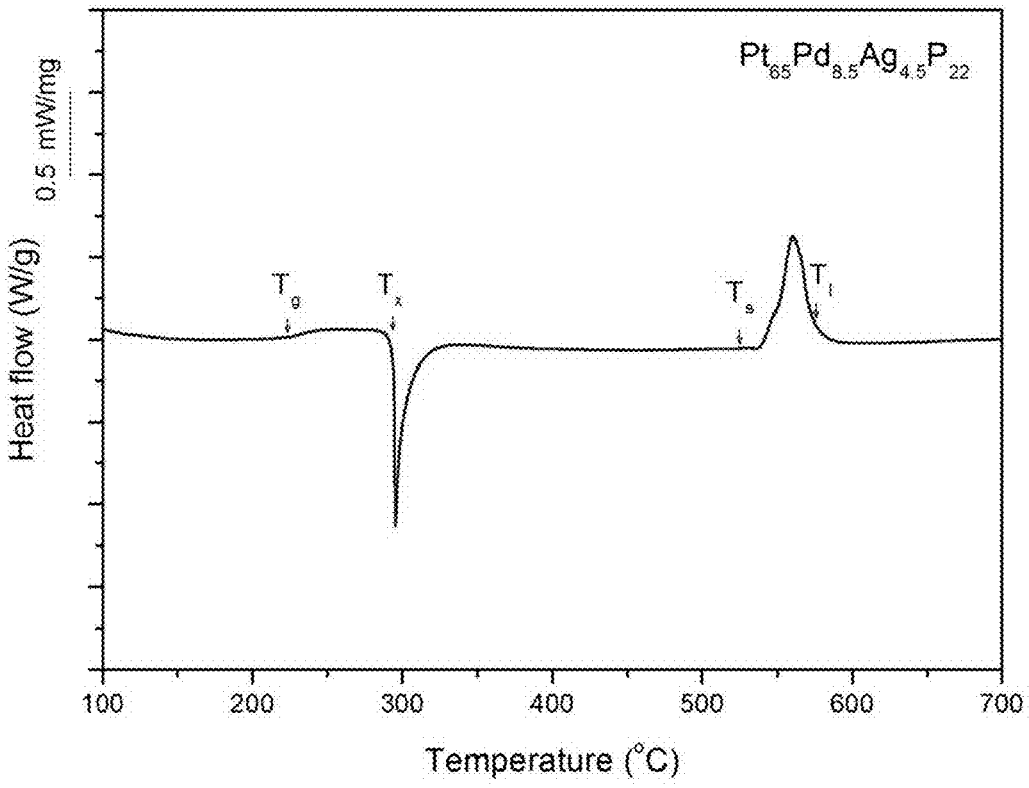
FIG. 15 provides a calorimetry scan for sample metallic glass $Pt_{65}Pd_{8.5}Ag_{4.5}P_{22}$ (Example 45). The glass transition temperature $T_g$, crystallization temperature $T_x$, solidus temperature $T_s$, and liquidus temperature $T_l$ are indicated by arrows.

As shown in Tables 7-11, alloys $Pt_{65}Pd_{8.5}Ag_{4.5}P_{22}$ (Example 44), $Pt_{65.25}Pd_{8.25}Ag_{4.5}P_{22}$ (Example 45), and $Pt_{65.5}Pd_{8}Ag_{4.5}P_{22}$ (Example 46) have the highest glass-forming ability among Pt—Pd—Ag—P alloys that satisfy the PT850 hallmark, demonstrating a critical rod diameter of 9 mm. FIG. 13 provides an image of a 9 mm diameter metallic glass rod with composition $Pt_{65}Pd_{8.5}Ag_{4.5}P_{22}$ (Example 45). FIG. 14 provides an x-ray diffractogram verifying the amorphous structure of a 9-mm diameter metallic glass rod with composition $Pt_{65}Pd_{8.5}Ag_{4.5}P_{22}$ (Example 45). FIG. 15 provides a calorimetry scan for sample metallic glass $Pt_{65}Pd_{8.5}Ag_{4.5}P_{22}$ (Example 45). The glass transition temperature $T_g$, crystallization temperature $T_x$, solidus temperature $T_s$, and liquidus temperature $T_l$ are indicated by arrows in FIG. 15. Table 12 lists the glass transition temperature $T_g$, crystallization temperature $T_x$, solidus temperature $T_s$, liquidus temperature $T_l$ and Vickers hardness (HV05) for sample metallic glass $Pt_{65}Pd_{8.5}Ag_{4.5}P_{22}$ (Example 45).

TABLE 12

Thermophysical and mechanical properties for Sample metallic glass $Pt_{65}Pd_{8.5}Ag_{4.5}P_{22}$ (Example 45)

| | |
|---|---|
| Glass-transition temperature | 223.0° C. |
| Crystallization temperature | 293.5° C. |
| $\Delta T_x(=T_x - T_g)$ | 70.5° C. |
| Glass-transition temperature | 223.0° C. |
| Solidus temperature | 525.3° C. |
| Liquidus temperature | 575.4° C. |
| Hardness | 374.3 ± 1.4 HV |

Description of Ni- and Au-Bearing Pt—P Alloys and Metallic Glass Compositions

In some embodiments, the disclosure is directed to Pt—P alloys and metallic glasses that also bear Ni and Au. In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 15 to 30 percent. The alloy also comprises Ni and Au, where the atomic fraction of Ni and Au is each in the range of 0.1 to 30 percent. Among other additional elements, the alloy may additionally comprise Cu in an atomic fraction of less than 2 percent. The critical rod diameter of the alloy is at least 3 mm.

In another embodiment, the atomic fraction of Pt is in the range of 50 to 65 percent, the atomic fraction of P is in the range of 20 to 28 percent, the atomic fraction of Ni and Au is each in the range of 0.1 to 23 percent, and wherein the Pt weight fraction is at least 85.0 percent.

In another embodiment, the disclosure is directed to an alloy capable of forming a metallic glass having a composition represented by the following formula (subscripts denote atomic percentages):

$$Pt_{(100-a-b-c)}Ni_aAu_bP_c$$

where:

a ranges from 0.1 to 30;

b ranges from 0.1 to 30;

c ranges from 15 to 30;

wherein the Pt weight fraction is between 74 and 91 percent; and wherein the critical rod diameter of the alloy is at least 3 mm.

In another embodiment, a ranges from 6 to 26, b ranges from 0.1 to 8, c ranges from 20 to 28, and the Pt weight fraction is at least 85.0 percent.

To illustrate the effects of including both Ni and Au in Pt—P alloys in terms of enhancing glass-forming ability, glass-forming ability data for Pt—P alloys that include both Ni and Au is compared against Pt—P alloys that include only Ni. It is demonstrated that by adding Au in Pt—Ni—P alloys the glass-forming ability of the quaternary alloys improve over the ternary alloys. It is also demonstrated that a certain Ni/Au combination exists where a peak in glass-forming ability is reached in Pt—Ni—Au—P alloys. At this peak, the critical rod diameter is many times larger than the critical rod diameter of the ternary alloy Pt—Ni—P.

Figure 16:
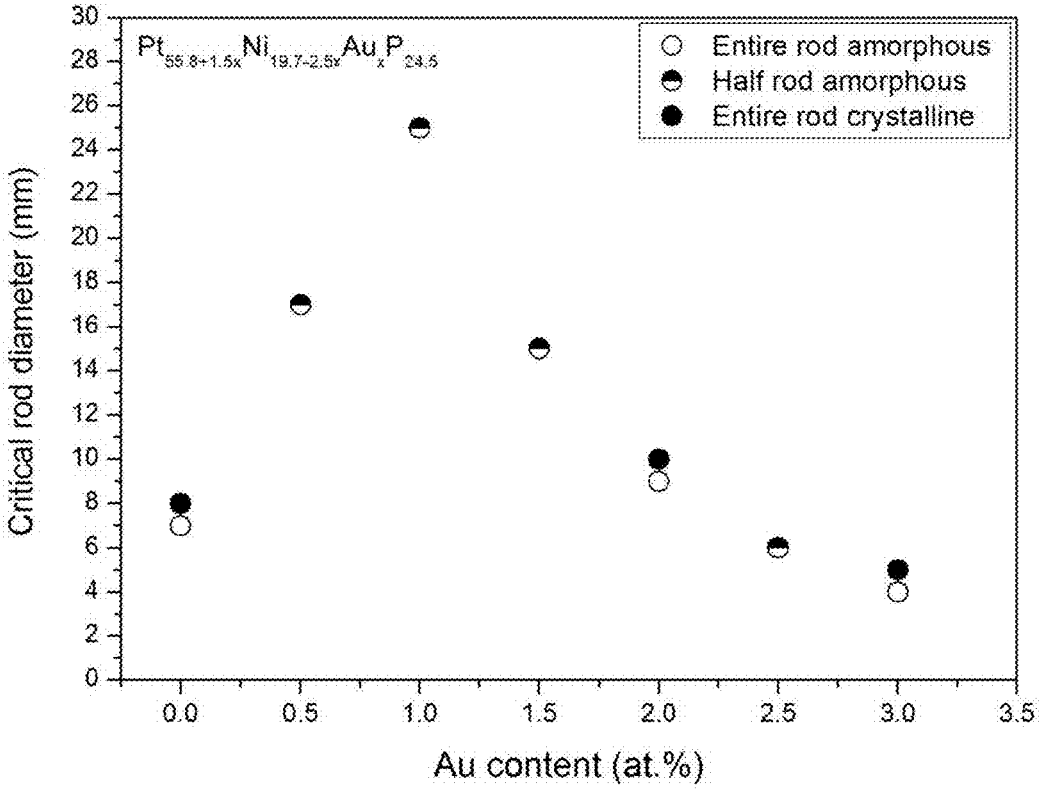
FIG. 16 provides a data plot showing the effect of varying the atomic fractions of Ni and Au on the glass-forming ability of alloys satisfying the PT850 hallmark according to composition $Pt_{55.8+1.5x}Ni_{19.7-2.5x}Au_xP_{24.5}$.

Specific embodiments of metallic glasses formed of Pt—P alloys comprising both Ni and Au with compositions according to the formula $Pt_{55.8+1.5x}Ni_{19.7-2.5x}Au_xP_{24.5}$ with Pt weight fraction of at least 85.0 percent satisfying the PT850 hallmark, are presented in Table 13. In these alloys, the atomic fraction of Ni varies from about 12 to about 20 percent, the atomic fraction of Au varies from greater than 0 up to about 3 percent, the atomic fraction of Pt varies from about 55 to about 61 percent, and the atomic fraction of P is constant at 24.5 percent, while all alloys have weight fractions of Pt of at least 85.0 percent. The critical rod diameters of the example alloys along with the Pt weight percentage are also listed in Table 13. FIG. 16 provides a data plot showing the effect of varying the atomic fractions of Ni and Au according to the composition formula $Pt_{55.8+1.5x}Ni_{19.7-2.5x}Au_xP_{24.5}$ on the glass-forming ability of the alloys.

TABLE 13

Sample metallic glasses demonstrating the effect of varying the Ni and Ag atomic concentrations according to the formula $Pt_{55.8+1.5x}Ni_{19.7-2.5x}Au_xP_{24.5}$ on the glass-forming ability of the alloys

| Example | Composition | Pt wt. % | Critical Rod Diameter [mm] |
|---|---|---|---|
| 7 | $Pt_{55.8}Ni_{19.7}P_{24.5}$ | 85.0 | 7 |
| 49 | $Pt_{56.5}Ni_{18.5}Au_{0.5}P_{24.5}$ | 85.0 | 17 |
| 50 | $Pt_{57.3}Ni_{17.2}Au_1P_{24.5}$ | 85.0 | 25 |
| 51 | $Pt_{58}Ni_{16}Au_{1.5}P_{24.5}$ | 85.0 | 15 |
| 52 | $Pt_{58.8}Ni_{14.7}Au_2P_{24.5}$ | 85.1 | 9 |
| 53 | $Pt_{59.5}Ni_{13.5}Au_{2.5}P_{24.5}$ | 85.0 | 6 |
| 54 | $Pt_{60.3}Ni_{12.2}Au_3P_{24.5}$ | 85.1 | 4 |

As shown in Table 13 and FIG. 16, substituting Ni by Au in $Pt_{55.8}Ni_{19.7}P_{24.5}$ according to $Pt_{55.8+1.5x}Ni_{19.7-2.5x}Au_xP_{24.5}$ improves glass-forming ability. Specifically, the critical rod diameter of the quaternary alloy is shown to increase from 7 mm for the ternary $Pt_{55.8}Ni_{19.7}P_{24.5}$ (Example 7), to a peak value of 25 mm for alloy $Pt_{57.3}Ni_{17.2}Au_1P_{24.5}$ (Example 50), and back to 4 mm for alloy $Pt_{60.3}Ni_{12.2}Au_3P_{24.5}$ (Example 54). As seen in Table 13 and FIG. 16, by including just 1 atomic percent of Au in $Pt_{55.8}Ni_{19.7}P_{24.5}$, the critical rod diameter increases from 7 mm to 25 mm, i.e. by nearly a factor of 4.

Figure 17:
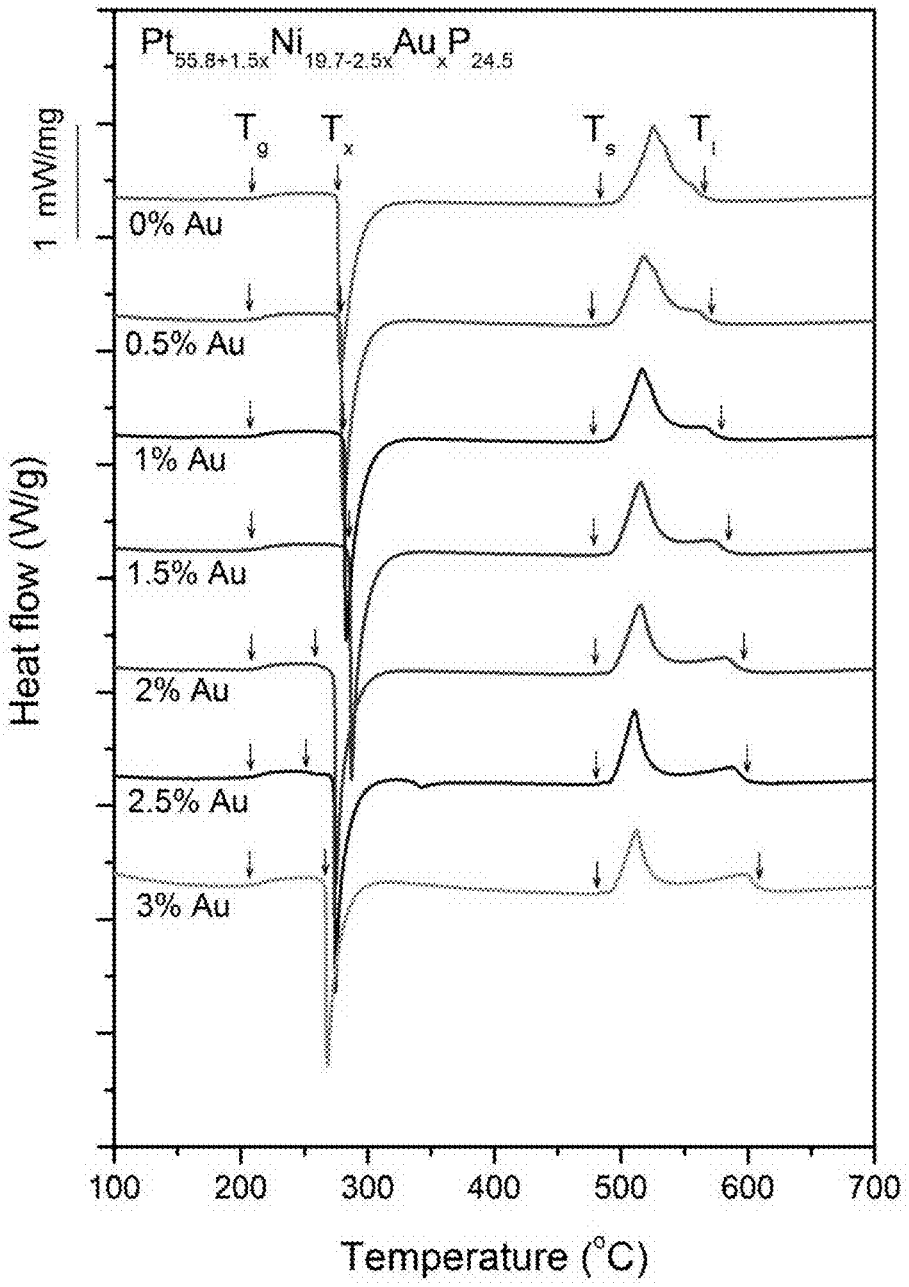
FIG. 17 provides calorimetry scans for sample metallic glasses $Pt_{55.8+1.5x}Ni_{19.7-2.5x}Au_xP_{24.5}$ in accordance with embodiments of the disclosure. The glass transition temperature $T_g$, crystallization temperature $T_x$, solidus temperature $T_s$, and liquidus temperature $T_l$ are indicated by arrows.

FIG. 17 provides calorimetry scans for sample metallic glasses according to $Pt_{55.8+1.5x}Ni_{19.7-2.5x}Au_xP_{24.5}$ in accordance with embodiments of the disclosure. The glass transition temperature $T_g$, crystallization temperature $T_x$, solidus temperature $T_s$, and liquidus temperature $T_l$ are indicated by arrows in FIG. 17, and are listed in Table 14. The difference between crystallization and glass-transition temperatures, $\Delta T_x = T_x - T_g$, is also listed in Table 14.

TABLE 14

Sample metallic glasses demonstrating the effect of varying the atomic fractions of Ni and Ag according to the formula $Pt_{55.8+1.5x}Ni_{19.7-2.5x}Au_xP_{24.5}$ on the glass-transition, crystallization, solidus, and liquidus temperatures of the alloys

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 7 | $Pt_{55.8}Ni_{19.7}P_{24.5}$ | 209.0 | 276.3 | 67.3 | 483.4 | 565.2 |
| 49 | $Pt_{56.5}Ni_{18.5}Au_{0.5}P_{24.5}$ | 207.3 | 278.8 | 71.5 | 476.8 | 571.5 |
| 50 | $Pt_{57.3}Ni_{17.2}Au_1P_{24.5}$ | 207.3 | 281.0 | 73.7 | 478.2 | 579.0 |
| 51 | $Pt_{58}Ni_{16}Au_{1.5}P_{24.5}$ | 208.0 | 285.6 | 77.6 | 477.9 | 584.7 |
| 52 | $Pt_{58.8}Ni_{14.7}Au_2P_{24.5}$ | 208.3 | 258.3 | 50.0 | 479.5 | 596.8 |
| 53 | $Pt_{59.5}Ni_{13.5}Au_{2.5}P_{24.5}$ | 207.2 | 251.2 | 44.0 | 481.8 | 599.1 |
| 54 | $Pt_{60.3}Ni_{12.2}Au_3P_{24.5}$ | 207.0 | 266.4 | 59.4 | 479.5 | 609.0 |

Figure 18:
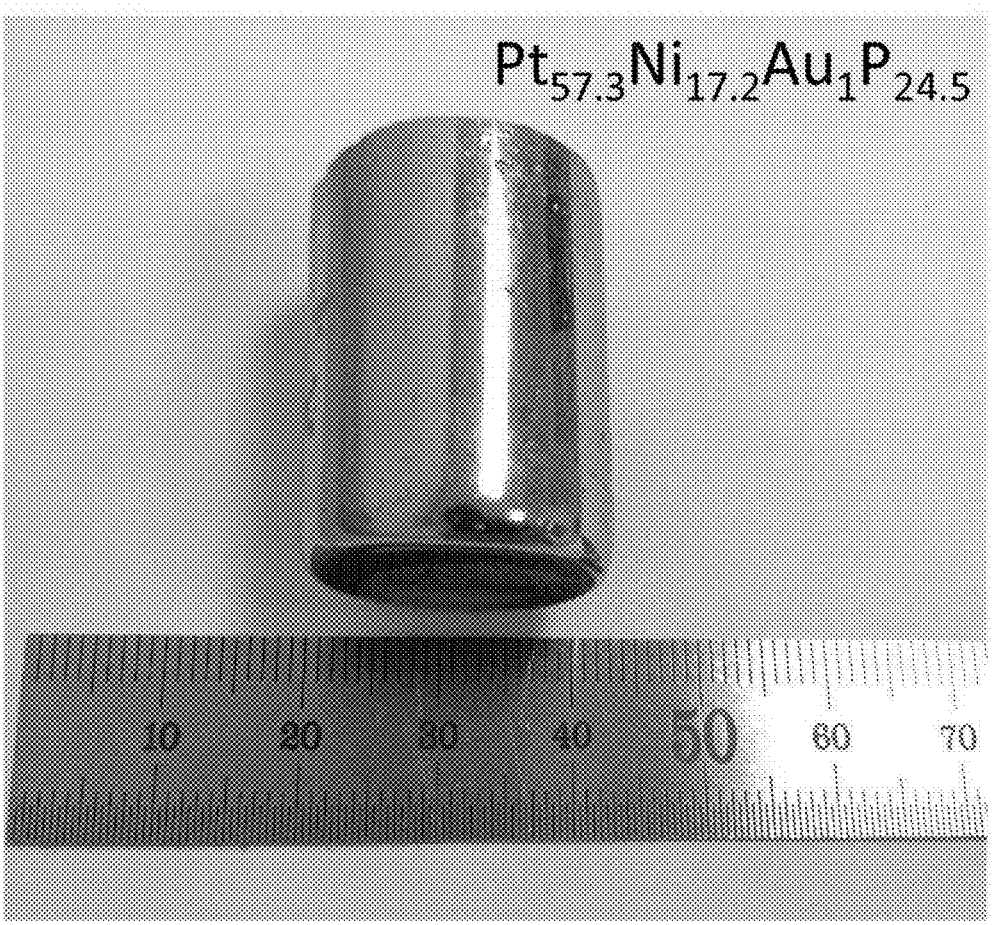
FIG. 18 provides an image of a 23 mm diameter metallic glass rod with composition $Pt_{57.3}Ni_{17.2}Au_1P_{24.5}$ (Example 50).
Figure 19:
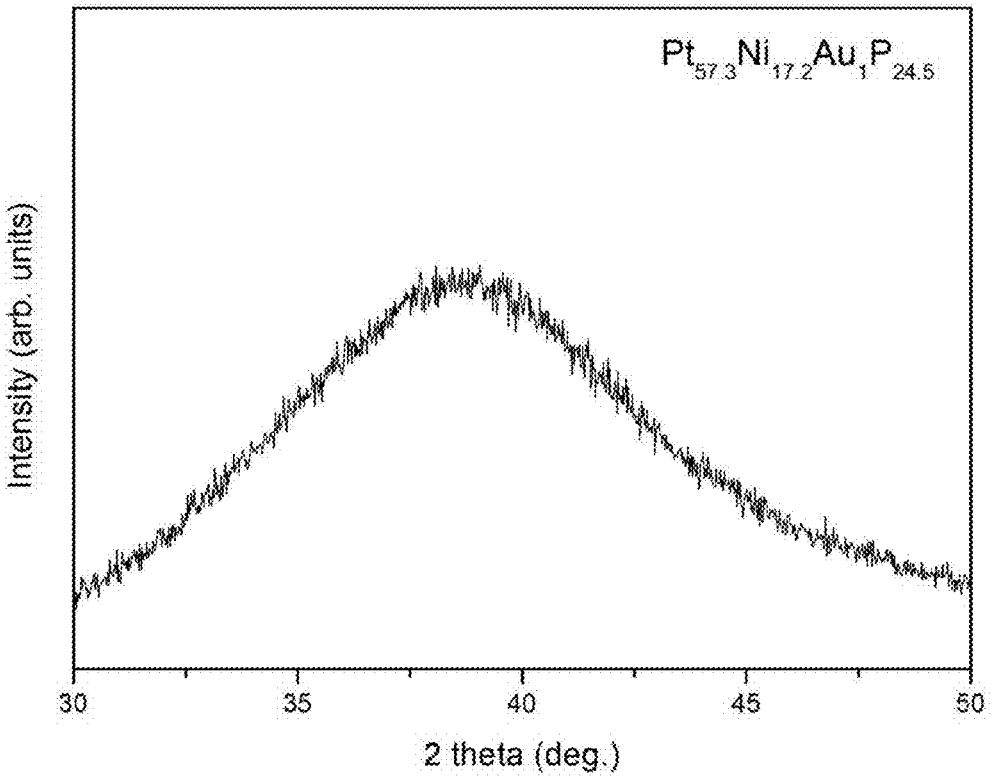
FIG. 19 provides an x-ray diffractogram verifying the amorphous structure of a 25 mm diameter metallic glass rod with composition $Pt_{57.3}Ni_{17.2}Au_1P_{24.5}$ (Example 50).

As shown in Table 13, alloy $Pt_{57.3}Ni_{17.2}Au_1P_{24.5}$ (Example 50) has the highest glass-forming ability among Pt—Ni—Au—P alloys that satisfy the PT850 hallmark, demonstrating a critical rod diameter of 25 mm. FIG. 18 provides an image of a 23 mm diameter metallic glass rod with composition $Pt_{57.3}Ni_{17.2}Au_1P_{24.5}$ (Example 50). FIG. 19 provides an x-ray diffractogram verifying the amorphous structure of a 25 mm diameter metallic glass rod with composition $Pt_{57.3}Ni_{17.2}Au_1P_{24.5}$ (Example 50). Table 15 lists the glass transition temperature $T_g$, crystallization temperature $T_x$, solidus temperature $T_s$, liquidus temperature $T_l$ and Vickers hardness (HV05) for sample metallic glass $Pt_{57.3}Ni_{17.2}Au_1P_{24.5}$ (Example 50).

TABLE 15

Thermophysical and mechanical properties for Sample metallic glass $Pt_{57.3}Ni_{17.2}Au_1P_{24.5}$ (Example 50)

| | |
|---|---|
| Glass-transition temperature | 207.3° C. |
| Crystallization temperature | 281.0° C. |
| $\Delta T_x (= T_x - T_g)$ | 73.7° C. |
| Solidus temperature | 478.2° C. |
| Liquidus temperature | 579.0° C. |
| Hardness | 418.0 ± 3.0 HV |

Description of Ni- and Pd-Bearing Pt—P Alloys and Metallic Glass Compositions

In some embodiments, the disclosure is directed to Pt—P alloys and metallic glasses that also bear Ni and Pd. In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 18 to 30 percent. The alloy also comprises Ni and Pd, where the atomic fraction of Ni and Pd is each in the range of 0.1 to 30 percent. Among other additional elements, the alloy may additionally comprise Cu in an atomic fraction of less than 2 percent. The critical rod diameter of the alloy is at least 3 mm.

In another embodiment, the atomic fraction of Pt is in the range of 50 to 65 percent, the atomic fraction of P is in the range of 20 to 28 percent, the atomic fraction of Ni is in the range of 0.1 to 25 percent, the atomic fraction of Pd is in the range of 0.1 to 10 percent, and wherein the Pt weight fraction is at least 85.0 percent.

In another embodiment, the disclosure is directed to an alloy capable of forming a metallic glass having a composition represented by the following formula (subscripts denote atomic percentages):

$$Pt_{(100-a-b-c)}Ni_aPd_bP_c$$

where:

a ranges from 0.1 to 30;

b ranges from 0.1 to 30;

c ranges from 18 to 30;

wherein the Pt weight fraction is between 74 and 91 percent; and wherein the critical rod diameter of the alloy is at least 3 mm.

In another embodiment, a ranges from 8 to 24, b ranges from 0.1 to 10, c ranges from 20 to 28, and the Pt weight fraction is at least 85.0 percent.

To illustrate the effects of including both Ni and Pd in Pt—P alloys in terms of enhancing glass-forming ability, glass-forming ability data for Pt—P alloys that include both Ni and Pd is compared against Pt—P alloys that include only Ni. It is demonstrated that by adding Pd in Pt—Ni—P alloys the glass-forming ability of the quaternary alloys improve over the ternary alloys. It is also demonstrated that a certain Ni/Pd combination exists where a peak in glass-forming ability is reached in Pt—Ni—Pd—P alloys. At this peak, the critical rod diameter is many times larger than the critical rod diameter of the ternary alloy Pt—Ni—P.

Figure 20:
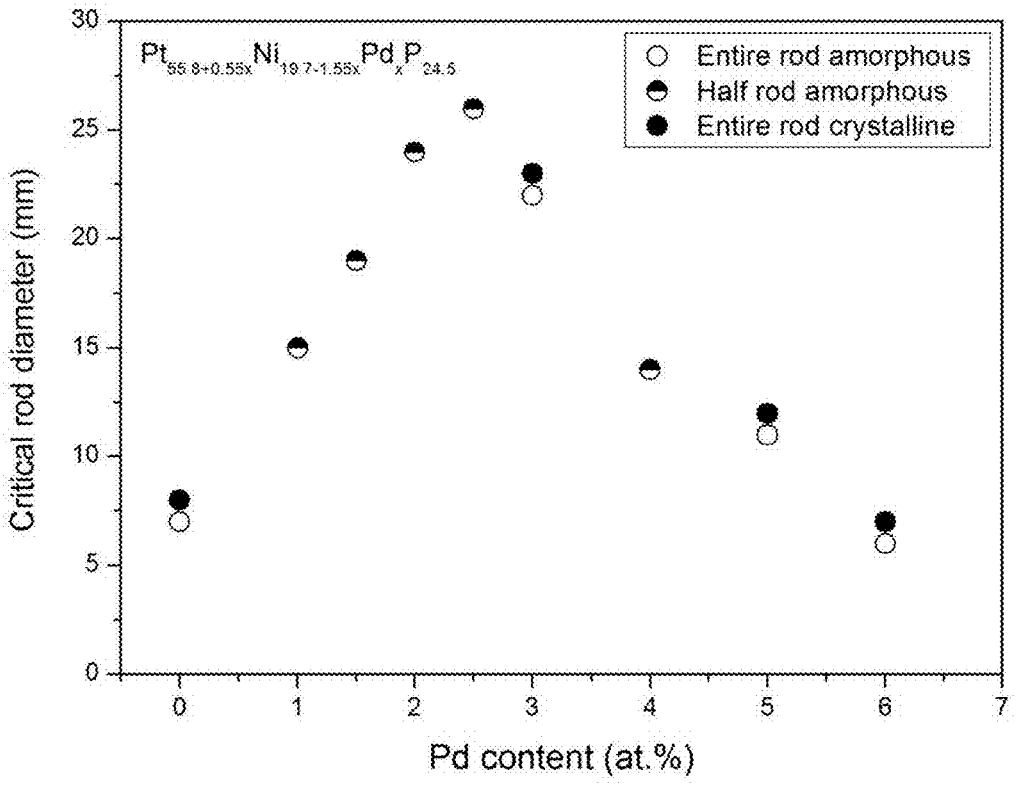
FIG. 20 provides a data plot showing the effect of varying the atomic fractions of Ni and Pd on the glass-forming ability of alloys satisfying the PT850 hallmark according to composition $Pt_{55.8+0.55x}Ni_{19.7-1.55x}Pd_xP_{24.5}$.

Specific embodiments of metallic glasses formed of Pt—P alloys comprising both Ni and Pd with compositions according to the formula $Pt_{55.8+0.55x}Ni_{19.7-1.55x}Pd_xP_{24.5}$ with Pt weight fraction of at least 85.0 percent satisfying the PT850 hallmark, are presented in Table 16. In these alloys, the atomic fraction of Ni varies from about 10 to about 20 percent, the atomic fraction of Pd varies from greater than 0 up to about 6 percent, the atomic fraction of Pt varies from about 55 to about 60 percent, and the atomic fraction of P is constant at 24.5 percent, while all alloys have weight fractions of Pt of at least 85.0 percent. The critical rod diameters of the example alloys along with the Pt weight percentage are also listed in Table 16. FIG. 20 provides a data plot showing the effect of varying the atomic fractions of Ni and Pd according to the composition formula $Pt_{55.8+0.55x}Ni_{19.7-1.55x}Pd_xP_{24.5}$ on the glass-forming ability of the alloys.

TABLE 16

Sample metallic glasses demonstrating the effect of increasing the Pd atomic concentration according to the formula $Pt_{55.8+0.55x}Ni_{19.7-1.55x}Pd_xP_{24.5}$ on the glass forming ability of the alloys

| Example | Composition | Pt wt. % | Critical Rod Diameter [mm] |
|---|---|---|---|
| 7 | $Pt_{55.8}Ni_{19.7}P_{24.5}$ | 85.0 | 7 |
| 55 | $Pt_{56.4}Ni_{18.1}Pd_1P_{24.5}$ | 85.1 | 15 |
| 56 | $Pt_{56.6}Ni_{17.4}Pd_{1.5}P_{24.5}$ | 85.1 | 19 |
| 57 | $Pt_{56.9}Ni_{16.6}Pd_2P_{24.5}$ | 85.1 | 24 |
| 58 | $Pt_{57.2}Ni_{15.8}Pd_{2.5}P_{24.5}$ | 85.1 | 26 |
| 59 | $Pt_{57.5}Ni_{15}Pd_3P_{24.5}$ | 85.1 | 22 |
| 60 | $Pt_{58}Ni_{13.5}Pd_4P_{24.5}$ | 85.1 | 14 |
| 61 | $Pt_{58.6}Ni_{11.9}Pd_5P_{24.5}$ | 85.2 | 11 |
| 62 | $Pt_{59.1}Ni_{10.4}Pd_6P_{24.5}$ | 85.2 | 6 |

As shown in Table 16 and FIG. 20, substituting Ni by Pd in $Pt_{55.8}Ni_{19.7}P_{24.5}$ according to $Pt_{55.8+0.55x}Ni_{19.7-1.55x}P$-

$d_xP_{24.5}$ improves glass-forming ability. Specifically, the critical rod diameter of the quaternary alloy is shown to increase from 7 mm for the ternary $Pt_{55.8}Ni_{19.7}P_{24.5}$ (Example 7), to a peak value of 26 mm for alloy $Pt_{57.2}Ni_{15.8}Pd_{2.5}P_{24.5}$ (Example 58), and back to 6 mm for alloy $Pt_{59.1}Ni_{10.4}Pd_6P_{24.5}$ (Example 62). As seen in Table 16 and FIG. 20, by including just 2.5 atomic percent of Pd in $Pt_{55.8}Ni_{19.7}P_{24.5}$, the critical rod diameter increases from 7 mm to 26 mm, i.e. by nearly a factor of 4.

Figure 21:
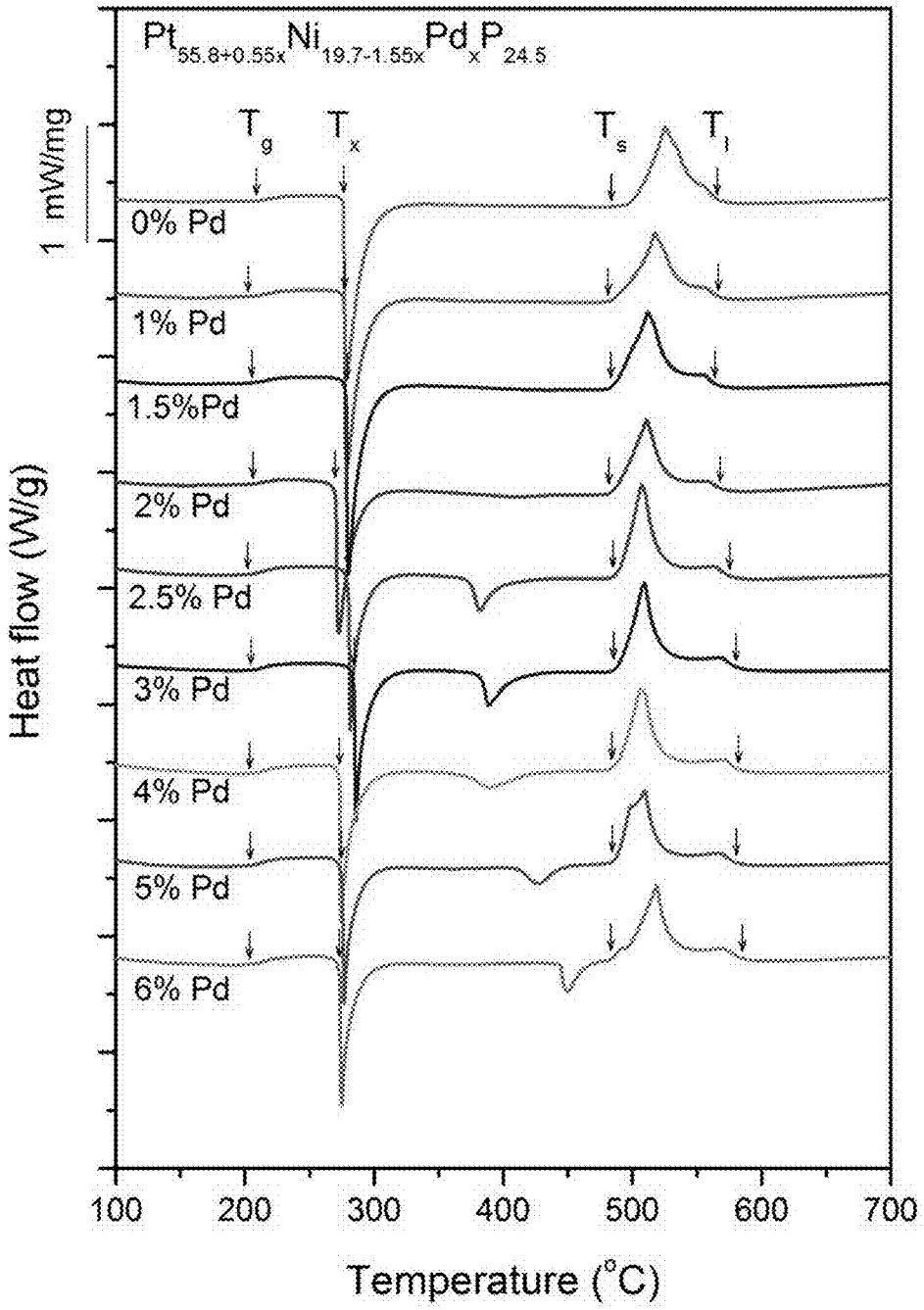
FIG. 21 provides calorimetry scans for sample metallic glasses $Pt_{55.8+0.55x}Ni_{19.7-1.55x}Pd_xP_{24.5}$ in accordance with embodiments of the disclosure. The glass transition temperature $T_g$, crystallization temperature $T_x$, solidus temperature $T_s$, and liquidus temperature $T_l$ are indicated by arrows.
Figure 22:
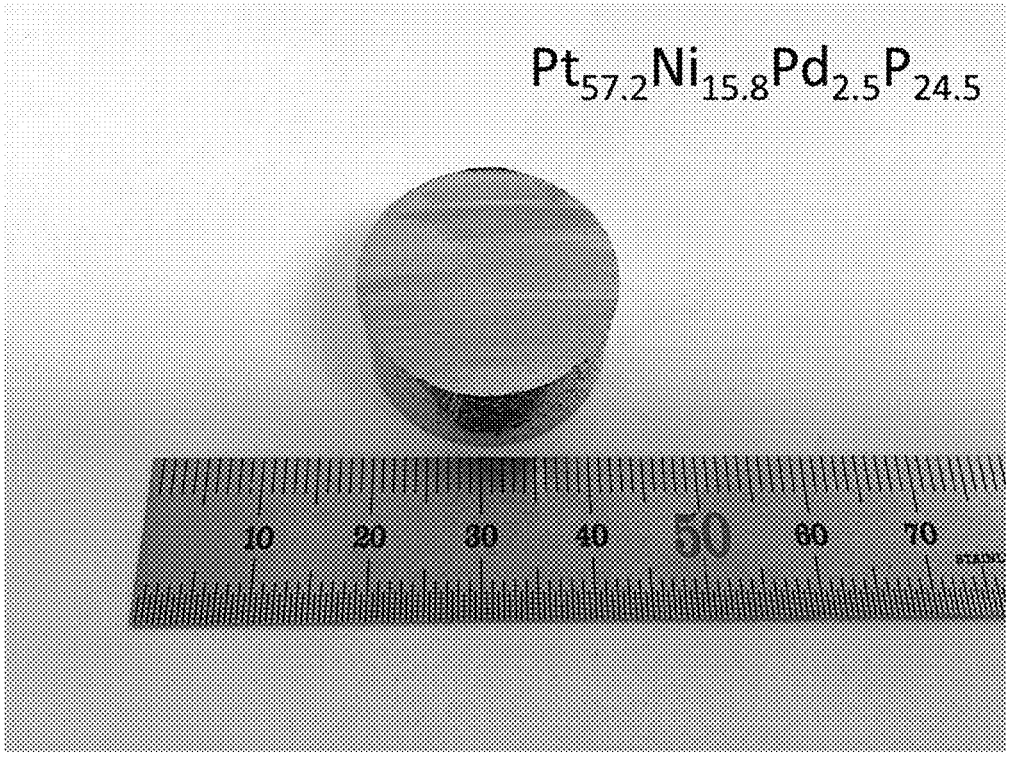
FIG. 22 provides an image of a 24 mm diameter metallic glass rod with composition $Pt_{57.2}Ni_{15.8}Pd_{2.5}P_{24.5}$ (Example 58).
Figure 23:
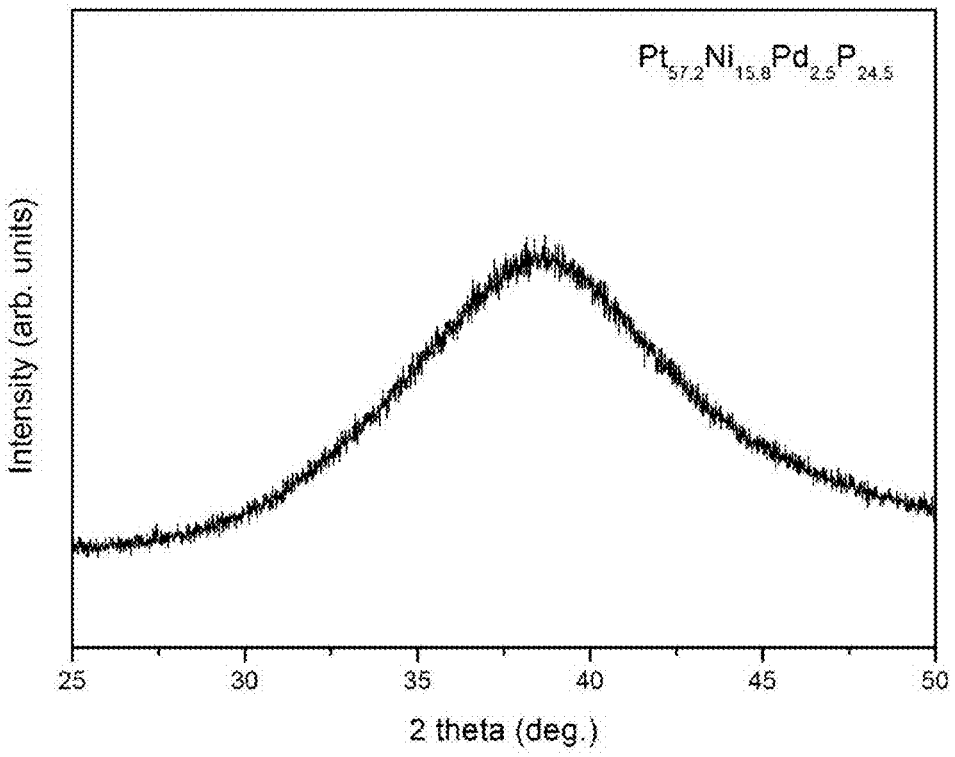
FIG. 23 provides an x-ray diffractogram verifying the amorphous structure of a 26 mm diameter metallic glass rod with composition $Pt_{57.2}Ni_{15.8}Pd_{2.5}P_{24.5}$ (Example 58).

FIG. 21 provides calorimetry scans for sample metallic glasses according to $Pt_{55.8+0.55x}Ni_{19.7-1.55x}Pd_xP_{24.5}$ in accordance with embodiments of the disclosure. The glass transition temperature $T_g$, crystallization temperature $T_x$, solidus temperature $T_s$, and liquidus temperature $T_l$ are indicated by arrows in FIG. 21, and are listed in Table 17. The difference between crystallization and glass-transition temperatures, $\Delta T_x = T_x - T_g$, is also listed in Table 17.

TABLE 17

Sample metallic glasses demonstrating the effect of increasing the Pd atomic concentration according to the formula $Pt_{55.8+0.55x}Ni_{19.7-1.55x}Pd_xP_{24.5}$ on the glass-transition, crystallization, solidus, and liquidus temperatures of the alloys

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 7 | $Pt_{55.8}Ni_{19.7}P_{24.5}$ | 209.0 | 276.3 | 67.3 | 483.4 | 565.2 |
| 55 | $Pt_{56.4}Ni_{18.1}Pd_1P_{24.5}$ | 202.8 | 276.9 | 74.1 | 482.6 | 568.3 |
| 56 | $Pt_{56.6}Ni_{17.4}Pd_{1.5}P_{24.5}$ | 205.5 | 278.3 | 72.8 | 486.0 | 564.8 |
| 57 | $Pt_{56.9}Ni_{16.6}Pd_2P_{24.5}$ | 205.9 | 270.4 | 64.5 | 485.6 | 570.0 |
| 58 | $Pt_{57.2}Ni_{15.8}Pd_{2.5}P_{24.5}$ | 202.0 | 279.6 | 77.6 | 488.6 | 575.1 |
| 59 | $Pt_{57.5}Ni_{15}Pd_3P_{24.5}$ | 204.8 | 284.4 | 79.6 | 489.2 | 582.0 |
| 60 | $Pt_{58}Ni_{13.5}Pd_4P_{24.5}$ | 203.3 | 273.3 | 70.0 | 488.4 | 583.1 |
| 61 | $Pt_{58.6}Ni_{11.9}Pd_5P_{24.5}$ | 203.4 | 274.9 | 71.5 | 488.4 | 580.6 |
| 62 | $Pt_{59.1}Ni_{10.4}Pd_6P_{24.5}$ | 203.1 | 273.4 | 70.3 | 485.0 | 585.2 |

Description of Pd-, Ag-, and Si-Bearing Pt—P Alloys and Metallic Glass Compositions In some embodiments, the disclosure is directed to Pt—P alloys and metallic glasses that also bear Pd, Ag, and Si. In one embodiment, the disclosure provides an alloy capable of forming a metallic glass that comprises at least Pt and P, where the atomic fraction of Pt is in the range of 45 to 75 percent and the weight fraction of Pt is between 74 and 91 percent, while the atomic fraction of P is in the range of 15 to 30 percent. The alloy also comprises Pd and Ag, where the atomic fraction of Pd and Ag is each in the range of 0.1 to 30 percent, and may also comprise Si in an atomic fraction of up 20 percent. Among other additional elements, the alloy may additionally comprise Cu in an atomic fraction of less than 2 percent. The critical rod diameter of the alloy is at least 3 mm.

In another embodiment, the atomic fraction of Pt is in the range of 50 to 65 percent, the atomic fraction of P is in the range of 10 to 28 percent, the atomic fraction of Pd and Ag is each in the range of 0.1 to 23 percent, the atomic fraction of Si is in the range of 0.1 to 15 percent, and wherein the Pt weight fraction is at least 85.0 percent.

In another embodiment, the disclosure is directed to an alloy capable of forming a metallic glass having a composition represented by the following formula (subscripts denote atomic percentages):

$$Pt_{(100-a-b-c)}Pd_aAg_bP_cSi_d$$

where:

a ranges from 0.1 to 30;

b ranges from 0.1 to 30;

c ranges from 5 to 30;

d is up to 20;

wherein the Pt weight fraction is between 74 and 91 percent; and wherein the critical rod diameter of the alloy is at least 3 mm.

In another embodiment, a ranges from 2 to 18, b ranges from 0.1 to 10, c ranges from 10 to 28, d ranges from 0.1 to 15, and the Pt weight fraction is at least 85.0 percent.

Figure 24:
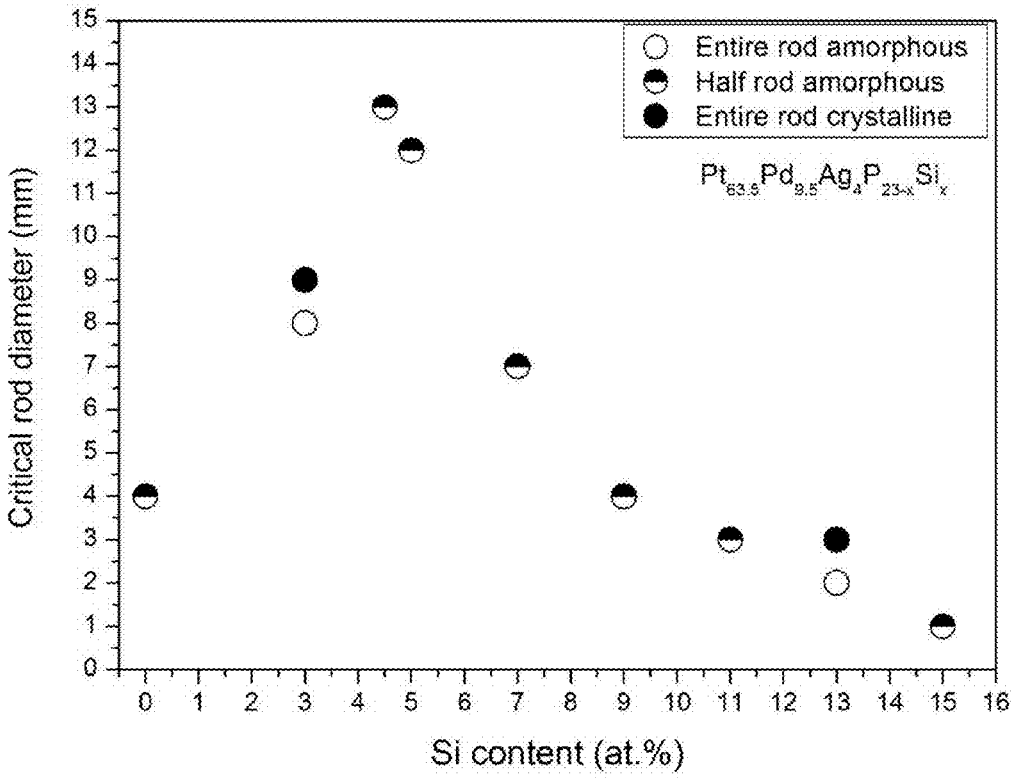
FIG. 24 provides a data plot showing the effect of varying the atomic fractions of P and Si on the glass-forming ability of alloys satisfying the PT850 hallmark according to composition $Pt_{63.5}Pd_{9.5}Ag_4P_{23-x}Si_x$.

Specific embodiments of metallic glasses formed of Pt—P alloys comprising Pd, Ag and Si with compositions according to the formula $Pt_{63.5}Pd_{9.5}Ag_4P_{23-x}Si_x$ with Pt weight fraction of at least 85.0 percent satisfying the PT850 hallmark are presented in Table 18. In these alloys, the atomic fraction of Si increases from 0 to 15 percent while the atomic fraction of P decreases from 23 to 8 percent. The atomic fraction of Pt is constant at 63.5 percent, the atomic fraction of Pd is constant at 9.5 percent, and the atomic fraction of Ag is constant at 4 percent. All alloys have weight fractions of Pt of at least 85.0 percent. The critical rod diameters of the example alloys along with the Pt weight percentage are also listed in Table 18. FIG. 24 provides a data plot showing the effect of varying the atomic fractions of P and Si according to the composition formula $Pt_{63.5}Pd_{9.5}Ag_4P_{23-x}Si_x$ on the glass-forming ability of the alloys.

TABLE 18

Sample metallic glasses demonstrating the effect of varying the P and Si atomic concentrations according to the formula $Pt_{63.5}Pd_{9.5}Ag_4P_{23-x}Si_x$ on the glass-forming ability of the alloys

| Example | Composition | Pt wt. % | Critical Rod Diameter [mm] |
|---|---|---|---|
| 30 | $Pt_{63.5}Pd_{9.5}Ag_4P_{23}$ | 85.2 | 4 |
| 63 | $Pt_{63.5}Pd_{9.5}Ag_4P_{20}Si_3$ | 85.2 | 8 |
| 64 | $Pt_{63.5}Pd_{9.5}Ag_4P_{18.5}Si_{4.5}$ | 85.3 | 13 |
| 65 | $Pt_{63.5}Pd_{9.5}Ag_4P_{18}Si_5$ | 85.3 | 12 |
| 66 | $Pt_{63.5}Pd_{9.5}Ag_4P_{16}Si_7$ | 85.3 | 7 |
| 67 | $Pt_{63.5}Pd_{9.5}Ag_4Pi_{14}Si_9$ | 85.3 | 4 |
| 68 | $Pt_{63.5}Pd_{9.5}Ag_4Pi_{12}Si_{11}$ | 85.4 | 3 |
| 69 | $Pt_{63.5}Pd_{9.5}Ag_4Pi_{10}Si_{13}$ | 85.4 | 2 |
| 70 | $Pt_{63.5}Pd_{9.5}Ag_4P_8Si_{15}$ | 85.4 | 1 |

As shown in Table 18 and FIG. 24, substituting P by Si in $Pt_{63.5}Pd_{9.5}Ag_4P_{23}$ according to $Pt_{63.5}Pd_{9.5}Ag_4P_{23-x}Si_x$ improves glass-forming ability. Specifically, the critical rod diameter of is shown to increase from 4 mm for the Si-free alloy $Pt_{63.5}Pd_{9.5}Ag_4P_{23}$ (Example 30), reaching a peak value of 13 mm for alloy $Pt_{63.5}Pd_{9.5}Ag_4P_{18.5}Si_{4.5}$ comprising 4.5 atomic percent Si (Example 64), beyond which it decreases as the Si content is increased further reaching 1 mm for alloy $Pt_{63.5}Pd_{9.5}Ag_4P_8Si_{15}$ comprising 15 atomic percent Si (Example 70). As seen in Table 18 and FIG. 24, by substituting 4.5 atomic percent of P by Si in $Pt_{63.5}Pd_{9.5}Ag_4P_{23}$, the critical rod diameter increases from 4 mm to 13 mm, i.e. by more than a factor of 3.

Figure 25:
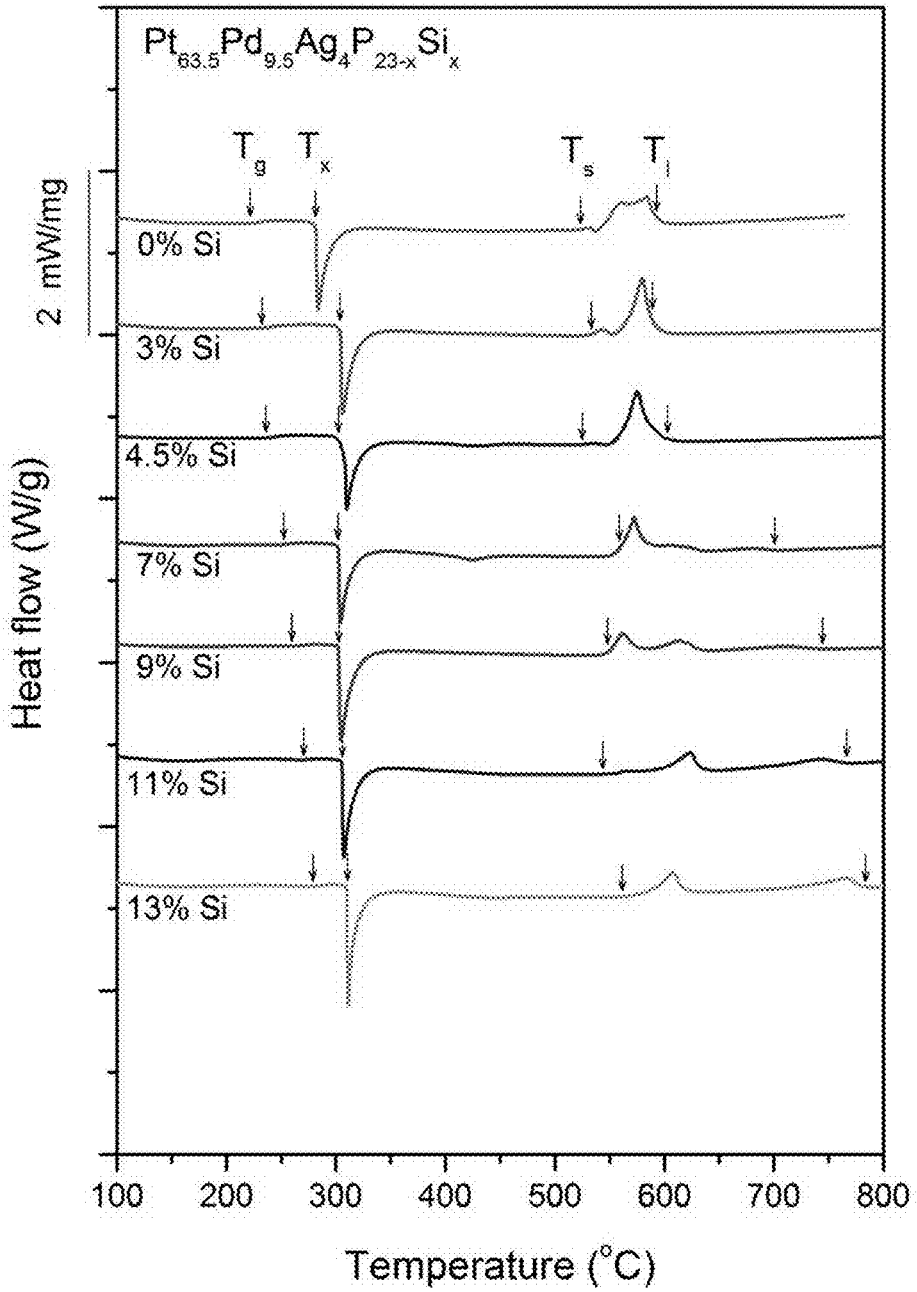
FIG. 25 provides calorimetry scans for sample metallic glasses $Pt_{63.5}Pd_{9.5}Ag_4P_{23-x}Si_x$ in accordance with embodiments of the disclosure. The glass transition temperature $T_g$, crystallization temperature $T_x$, solidus temperature $T_s$, and liquidus temperature $T_l$ are indicated by arrows.

FIG. 25 provides calorimetry scans for sample metallic glasses according to $Pt_{63.5}Pd_{9.5}Ag_4P_{23-x}Si_x$ in accordance with embodiments of the disclosure. The glass transition temperature $T_g$, crystallization temperature $T_x$, solidus temperature $T_s$, and liquidus temperature $T_l$ are indicated by arrows in FIG. 25, and are listed in Table 19. The difference between crystallization and glass-transition temperatures, $\Delta T_x = T_x - T_g$, is also listed in Table 19. As seen in FIG. 25 and Table 19, by substituting P by Si, $T_g$ increases monotonically from 221.5° C. for the Si-Free alloy $Pt_{63.5}Pd_{9.5}Ag_4P_{23}$ (Example 30) to 279.1° C. for alloy $Pt_{63.5}Pd_{9.5}Ag_4P_{10}Si_{13}$ comprising 13 atomic percent Si (Example 69). Also, by substituting P by Si, 7) increases monotonically from 594.0°

C. for the Si-Free alloy $Pt_{63.5}Pd_{9.5}Ag_4P_{23}$ (Example 30) to 783.2° C. for alloy $Pt_{63.5}Pd_{9.5}Ag_4P_{10}Si_{13}$ comprising 13 atomic percent Si (Example 69). Lastly, by substituting P by Si, $\Delta T_x$ decreases monotonically from 60.3° C. for the Si-Free alloy $Pt_{63.5}Pd_{9.5}Ag_4P_{23}$ (Example 30) to 30.6° C. for alloy $Pt_{63.5}Pd_{9.5}Ag_4P_{10}Si_{13}$ comprising 13 atomic percent Si (Example 69).

TABLE 19

Sample metallic glasses demonstrating the effect of varying the atomic fractions of Ni and Ag according to the formula $Pt_{63.5}Pd_{9.5}Ag_4P_{23-x}Si_x$ on the glass-transition, crystallization, solidus, and liquidus temperatures of the alloys

| Example | Composition | $T_g$ (° C.) | $T_x$ (° C.) | $\Delta T_x$ (K) | $T_s$ (° C.) | $T_l$ (° C.) |
|---|---|---|---|---|---|---|
| 30 | $Pt_{63.5}Pd_{9.5}Ag_4P_{23}$ | 221.5 | 281.8 | 60.3 | 523.6 | 594.0 |
| 63 | $Pt_{63.5}Pd_{9.5}Ag_4P_{20}Si_3$ | 232.2 | 303.6 | 71.4 | 532.8 | 589.4 |
| 64 | $Pt_{63.5}Pd_{9.5}Ag_4P_{18.5}Si_{4.5}$ | 236.0 | 302.3 | 66.3 | 524.9 | 603.0 |
| 66 | $Pt_{63.5}Pd_{9.5}Ag_4P_{16}Si_7$ | 252.9 | 302.3 | 49.4 | 558.4 | 701.8 |
| 67 | $Pt_{63.5}Pd_{9.5}Ag_4P_{14}Si_9$ | 259.0 | 302.5 | 43.5 | 548.0 | 745.9 |
| 68 | $Pt_{63.5}Pd_{9.5}Ag_4P_{12}Si_{11}$ | 270.5 | 305.4 | 34.9 | 543.1 | 765.8 |
| 69 | $Pt_{63.5}Pd_{9.5}Ag_4P_{10}Si_{13}$ | 279.1 | 309.7 | 30.6 | 561.3 | 783.2 |

Other metallic glasses according to embodiments of the disclosure with Pt weight fraction of at least 85.0 percent satisfying the PT850 hallmark are presented in Table 20. The critical rod diameters of the example alloys along with the Pt weight percentage are also listed in Table 20.

TABLE 20

Other metallic glasses according to embodiments of the disclosure

| Example | Composition | Pt wt. % | Critical Rod Diameter [mm] |
|---|---|---|---|
| 70 | $Pt_{63.5}Pd_{10}Ag_4P_{18}Si_{4.5}$ | 85.0 | 12 |
| 71 | $Pt_{63}Pd_9Ag_4P_{18.5}Si_{4.5}$ | 85.7 | 12 |
| 72 | $Pt_{63.25}Pd_{9.5}Ag_{4.25}P_{18.5}Si_{4.5}$ | 85.1 | 13 |
| 73 | $Pt_{63.25}Pd_{9.25}Ag_{4.5}P_{18.5}Si_{4.5}$ | 85.0 | 12 |
| 74 | $Pt_{63.25}Pd_{9.5}Ag_{4.25}P_{18.75}Si_{4.25}$ | 85.0 | 12 |
| 75 | $Pt_{63.25}Pd_{9.5}Ag_{4.25}P_{18.25}Si_{4.75}$ | 85.1 | 12 |

Figure 26:
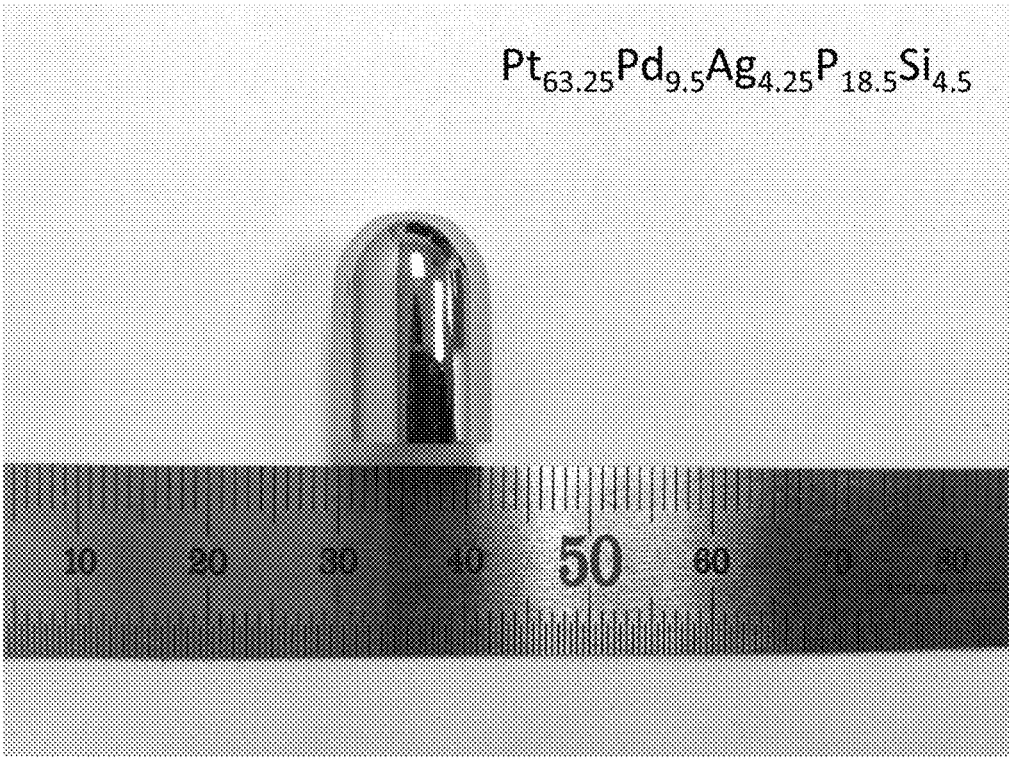
FIG. 26 provides an image of a 13 mm diameter metallic glass rod with composition $Pt_{63.25}Pd_{9.5}Ag_{4.25}P_{18.5}Si_{4.5}$ (Example 72).
Figure 27:
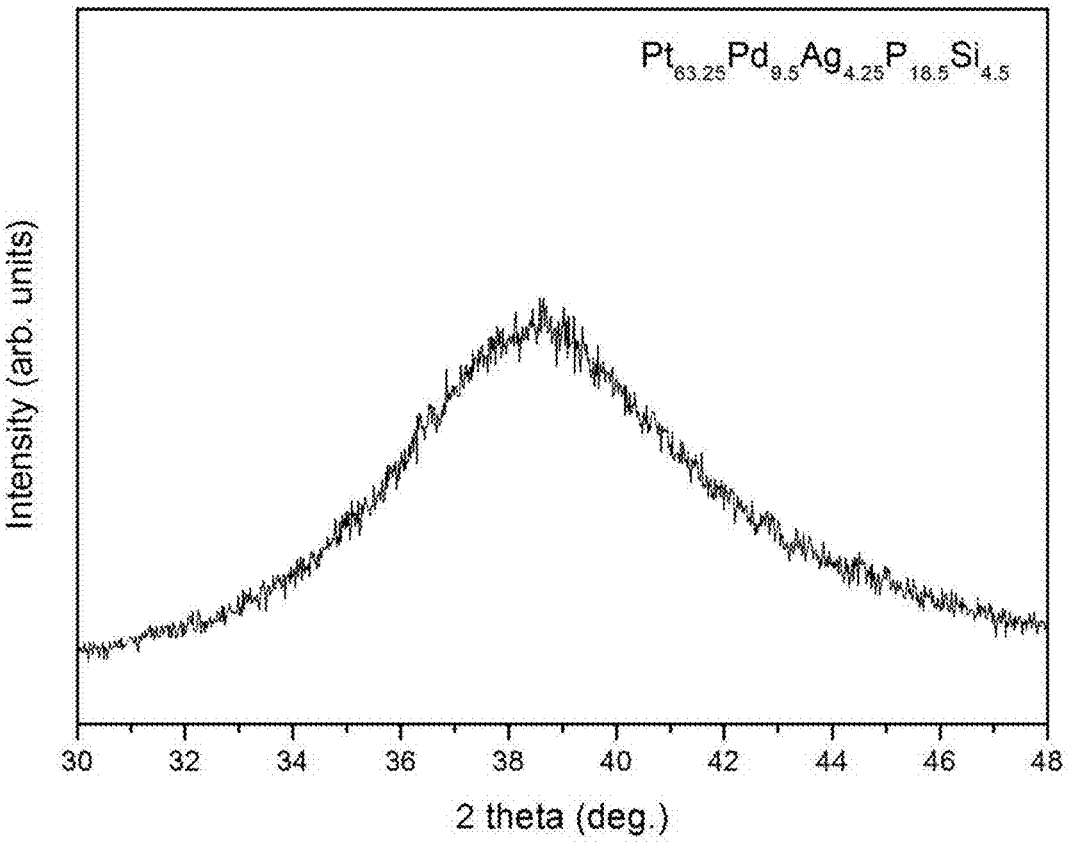
FIG. 27 provides an x-ray diffractogram verifying the amorphous structure of a 13-mm diameter metallic glass rod with composition $Pt_{63.25}Pd_{9.5}Ag_{4.25}P_{18.5}Si_{4.5}$ (Example 72).

As shown in Tables 18 and 20, alloys $Pt_{63.5}Pd_{9.5}Ag_4P_{18.5}Si_{4.5}$ (Example 64) and $Pt_{63.25}Pd_{9.5}Ag_{4.25}P_{18.5}Si_{4.5}$ (Example 72) have the highest glass-forming ability among Pt—Pd—Ag—P—Si alloys that satisfy the PT850 hallmark, demonstrating a critical rod diameter of 13 mm. FIG. 26 provides an image of a 13 mm diameter metallic glass rod with composition $Pt_{63.25}Pd_{9.5}Ag_{4.25}P_{18.5}Si_{4.5}$ (Example 72). FIG. 27 provides an x-ray diffractogram verifying the amorphous structure of a 13 mm diameter metallic glass rod with composition $Pt_{63.25}Pd_{9.5}Ag_{4.25}P_{18.5}Si_{4.5}$ (Example 72).

Description of Methods of Processing the Ingots of the Sample Alloys

A method for producing the alloy ingots involves inductive melting of the appropriate amounts of elemental constituents in a quartz tube under inert atmosphere. The purity levels of the constituent elements were as follows: Pt 99.99%, Pd 99.95%, Au 99.99%, Ag 99.95%, Ni 99.995%, P 99.9999%, and Si 99.9999%. The melting crucible may alternatively be a ceramic such as alumina or zirconia, graphite, sintered crystalline silica, or a water-cooled hearth made of copper or silver. In some embodiments, P can be incorporated in the alloy as a pre-alloyed compound formed with at least one of the other elements, like for example, as a Pt—P or a Ni—P compound.

Description of Methods of Processing the Sample Metallic Glasses

A particular method for producing metallic glass rods from the alloy ingots for the sample alloys involves remelting the alloy ingots in quartz tubes having 0.5 mm thick walls in a furnace at 850° C. under high purity argon and rapidly quenching in a room-temperature water bath. In some embodiments, the melt temperature prior to quenching is between 700 and 1200° C., while in other embodiments it is between 700 and 950° C., and yet in other embodiments between 700 and 800° C. In some embodiments, the bath could be ice water or oil. In other embodiments, metallic glass articles can be formed by injecting or pouring the molten alloy into a metal mold. In some embodiments, the mold can be made of copper, brass, or steel, among other materials.

Description of Methods of Fluxing the Ingots of the Sample Alloys

Optionally, prior to producing a metallic glass article, the alloyed ingots may be fluxed with a reducing agent. In one embodiment, the reducing agent can be dehydrated boron oxide ($B_2O_3$). A particular method for fluxing the alloys of the disclosure involves melting the ingots and $B_2O_3$ in a quartz tube under inert atmosphere at a temperature in the range of 750 and 900° C., bringing the alloy melt in contact with the $B_2O_3$ melt and allowing the two melts to interact for about 1000 s, and subsequently quenching in a bath of room temperature water. In some embodiments, the melt and $B_2O_3$ are allowed to interact for at least 500 seconds prior to quenching, and in some embodiments for at least 2000 seconds. In some embodiments, the melt and $B_2O_3$ are allowed to interact at a temperature of at least 700° C., and in other embodiments between 800 and 1200° C. In yet other embodiments, the step of producing the metallic glass rod may be performed simultaneously with the fluxing step, where the water-quenched sample at the completion of the fluxing step represents the metallic glass rod.

Description of Methods of Processing the Pt—Ni—Pd—P Sample Metallic Glasses

A particular method for producing Pt—Ni—Pd—P metallic glass rods from the alloy ingots for the sample alloys involves melting the ingots and $B_2O_3$ in a quartz tube under inert atmosphere, bringing the alloy melt in contact with the $B_2O_3$ melt and allowing the two melts to interact at 900° C. for about 1000 s, and subsequently quenching in a bath of room temperature water.

Test Methodology for Assessing Glass-Forming Ability by Tube Quenching

The glass-forming ability of the alloys were assessed by determining the maximum rod diameter in which the amorphous phase of the alloy (i.e. the metallic glass phase) could be formed when processed by the method of water-quenching a quartz tube containing the alloy melt, as described above. X-ray diffraction with Cu-Kα radiation was performed to verify the amorphous structure of the quenched rods.

Test Methodology for Differential Scanning calorimetry

Differential scanning calorimetry was performed on sample metallic glasses at a scan rate of 20 K/min to determine the glass-transition, crystallization, solidus, and liquidus temperatures of sample metallic glasses.

Test Methodology for Measuring Hardness

The Vickers hardness (HV0.5) of sample metallic glasses was measured using a Vickers microhardness tester. Eight tests were performed where micro-indentions were inserted on a flat and polished cross section of a 3 mm metallic glass rod using a load of 500 g and a duel time of 10 s.

The alloys and metallic glasses described herein can be valuable in the fabrication of electronic devices. An electronic device herein can refer to any electronic device known in the art. For example, it can be a telephone, such as a mobile phone, and a landline phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An alloy capable of forming a metallic glass comprising:

Pt having an atomic fraction in the range of 45 to 75 percent, where the weight fraction of Pt is between 74 and 91 percent;

P having an atomic fraction in the range of 18 to 30 percent;

at least two additional element selected from the group consisting of Ni, Pd, Ag, and Au where the atomic fraction of each of the at least two additional elements is in the range of 0.1 to 30 percent;

Cu at an atomic fraction of less than 2 percent; and wherein the critical rod diameter of the alloy is at least 3 mm.

2. The alloy of claim 1, where the atomic fraction of Pt is in the range of 50 to 65 percent, the atomic fraction of P is in the range of 20 to 28 percent, the atomic fraction of each of the at least two additional elements selected from the group consisting of Ni, Pd, Ag, and Au is in the range of 0.1 to 26 percent, and wherein the Pt weight fraction is at least 85.0 percent.

3. A metallic glass comprising an alloy of claim 1.

4. An alloy capable of forming a metallic glass having a composition represented by the following formula (subscripts denote atomic percentages):

$$Pt_{(100-a-b-c-d-e)}Ni_aPd_bAg_cAu_dP_e$$

where:

a is up to 30;

b is up to 30;

c is up to 30;

d is up to 30;

e ranges from 18 to 30;

wherein at least two of a, b, c, and d are at least 0.1;

wherein the Pt weight fraction is between 74 and 91 percent; and wherein the critical rod diameter of the alloy is at least 3 mm.

5. The alloy of claim 4, where a, b, c, and d are up to 26, and wherein the Pt weight fraction is at least 85.0 percent.

6. The alloy of claim 4, where a ranges from 8 to 24, b ranges from 0.1 to 10, c and d are 0, and e ranges from 20 to 29.

7. The alloy of claim 4, where a ranges from 12 to 20, b ranges from 0.1 to 6, c and d are 0, e ranges from 22 to 27, and wherein the critical rod diameter of the alloy is at least 5 mm.

8. The alloy of claim 4, where a ranges from 4 to 20, c ranges from 0.1 to 10, b and d are 0, and e ranges from 20 to 28.

9. The alloy of claim 4, where a ranges from 7 to 19, c ranges from 0.2 to 8, b and d are 0, e ranges from 23 to 27, and wherein the critical rod diameter of the alloy is at least 5 mm.

10. The alloy of claim 4, where a ranges from 13 to 19, c ranges from 0.5 to 4, b and d are 0, e ranges from 24 to 26, and wherein the critical rod diameter of the alloy is at least 15 mm.

11. The alloy of claim 4, where a ranges from 6 to 26, d ranges from 0.1 to 8, b and c are 0, and e ranges from 20 to 28.

12. The alloy of claim 4, where a ranges from 10 to 22, d ranges from 0.1 to 6, b and c are 0, e ranges from 23 to 27, and wherein the critical rod diameter of the alloy is at least 5 mm.

13. The alloy of claim 4, where b ranges from 2 to 12, c ranges from 0.1 to 10, a and d are 0, and e ranges from 18 to 25.

14. The alloy of claim 4, b ranges from 3 to 11, c ranges from 3 to 9, a and d are 0, e ranges from 20 to 24, and wherein the critical rod diameter of the alloy is at least 4 mm.

15. A metallic glass comprising an alloy of claim 4.

16. An alloy capable of forming a metallic glass having a composition represented by the following formula (subscripts denote atomic percentages):

$$Pt_{(100-a-b-c-d-e)}Ni_aPd_bAg_cAu_dP_eSi_f$$

where:

a is up to 30;

b is up to 30;

c is up to 30;

d is up to 30;

e ranges from 5 to 30;

f is up to 20;

wherein at least two of a, b, c, and d are at least 0.1;

wherein the Pt weight fraction is between 74 and 91 percent; and wherein the critical rod diameter of the alloy is at least 3 mm.

17. The alloy of claim 16, where a, b, c, and d are up to 26, and wherein the Pt weight fraction is at least 85.0 percent.

18. The alloy of claim 16, where b ranges from 2 to 18, c ranges from 0.1 to 10, a and d are 0, e ranges from 10 to 28, and f ranges from 0.1 to 15.

19. The alloy of claim 16, b ranges from 6 to 13, c ranges from 2 to 7, a and d are 0, e ranges from 12 to 25, f ranges from 0.5 to 10, and wherein the critical rod diameter of the alloy is at least 4 mm.

20. A metallic glass comprising an alloy of claim 17.

* * * * *